US011105148B2

(12) United States Patent
Shipman

(10) Patent No.: US 11,105,148 B2
(45) Date of Patent: Aug. 31, 2021

(54) SCREEN ASSEMBLY

(71) Applicant: Simon Shipman, Southport (AU)

(72) Inventor: Simon Shipman, Southport (AU)

( * ) Notice: Subject to any disclaimer, the term of this patent is extended or adjusted under 35 U.S.C. 154(b) by 403 days.

(21) Appl. No.: 16/317,267

(22) PCT Filed: Jul. 21, 2017

(86) PCT No.: PCT/AU2017/050756

§ 371 (c)(1),
(2) Date: Jan. 11, 2019

(87) PCT Pub. No.: WO2018/014089

PCT Pub. Date: Jan. 25, 2018

(65) Prior Publication Data

US 2019/0301242 A1 Oct. 3, 2019

(30) Foreign Application Priority Data

Jul. 21, 2016 (AU) ..... 2016902857

(51) Int. Cl.
*E06B 9/54* (2006.01)
*E06B 9/42* (2006.01)
(Continued)

(52) U.S. Cl.
CPC ..... *E06B 9/42* (2013.01); *E06B 9/50* (2013.01); *E06B 9/54* (2013.01); *E06B 9/58* (2013.01);
(Continued)

(58) Field of Classification Search
CPC ..... E06B 9/42; E06B 9/50; E06B 9/54; E06B 9/58; E06B 9/581; E06B 2009/543; E06B 2009/805
See application file for complete search history.

(56) References Cited

U.S. PATENT DOCUMENTS 3,842,890 A * 10/1974 Kramer ..... E06B 9/13 160/26
3,911,990 A * 10/1975 Hoover ..... E06B 9/54 160/100
(Continued)

FOREIGN PATENT DOCUMENTS

CA 2369870 A1 7/2002
WO WO-0142613 A1 6/2001
(Continued)

OTHER PUBLICATIONS

Supplementary European Search Report for application No. EP17830121, dated Feb. 13, 2020.

*Primary Examiner* — Johnnie A. Shablack
(74) *Attorney, Agent, or Firm* — Cesari and McKenna, LLP

(57) ABSTRACT

A screen assembly includes a support structure. A roller assembly is mounted on the support structure. A flexible panel with a distal end is mounted on the roller assembly so that the flexible panel can be wound on to and off the roller assembly as the flexible panel is retracted and extended. Two opposed track assemblies are arranged on the support structure, sides of the flexible panel and each track assembly being configured so that the sides of the flexible panel can slide within the track assemblies as the flexible panel is retracted and extended. At least one of the track assemblies has a static support that is fixed relative to the support structure and a dynamic support that is displaceable relative to the static support. An adjustment mechanism is operatively connected to the static and dynamic supports to adjust a lateral position of the dynamic support relative to the static support. An elongate guide assembly is mounted on a proximal end of the flexible panel to guide movement of the flexible panel with respect to the track assemblies. An adjustment mechanism is operatively connected to the static
(Continued)

and dynamic supports to adjust a lateral position of the dynamic support relative to the static support. An insert is mounted on at least one end of the guide assembly. The dynamic support of said at least one of the track assemblies includes a runner in which the insert is received to slide or roll with respect to the dynamic support as the flexible panel is retracted and extended.

17 Claims, 24 Drawing Sheets

(51) Int. Cl.

| | |
|---|---|
| ***E06B 9/58*** | (2006.01) |
| ***E06B 9/78*** | (2006.01) |
| ***E06B 9/80*** | (2006.01) |
| ***E06B 9/90*** | (2006.01) |
| ***E06B 9/50*** | (2006.01) |
| ***E06B 9/60*** | (2006.01) |

(52) U.S. Cl.
CPC ..... *E06B 9/581* (2013.01); *E06B 9/60* (2013.01); *E06B 9/78* (2013.01); *E06B 9/80* (2013.01); *E06B 9/90* (2013.01); *E06B 2009/543* (2013.01); *E06B 2009/805* (2013.01)

(56) References Cited

U.S. PATENT DOCUMENTS

| | | | | | |
|---|---|---|---|---|---|
| 4,359,081 | A * | 11/1982 | Brower | E06B 9/54 | 160/243 |
| 4,821,786 | A * | 4/1989 | Johnston | E06B 9/40 | 16/78 |
| 4,825,921 | A * | 5/1989 | Rigter | E06B 9/54 | 160/23.1 |
| 4,993,468 | A * | 2/1991 | Hackman | E06B 9/264 | 160/100 |
| 5,868,191 | A * | 2/1999 | Blackmon, Jr. | A47H 21/00 | 160/31 |
| 6,059,007 | A * | 5/2000 | Tomita | E06B 9/54 | 160/242 |
| 6,408,922 | B2 * | 6/2002 | Desrochers | E06B 9/54 | 160/24 |
| 6,478,070 | B2 | 11/2002 | Poppema | | |
| 6,591,890 | B1 * | 7/2003 | Grubb | E06B 9/80 | 160/291 |
| 6,629,555 | B2 * | 10/2003 | DeBlock | E06B 9/54 | 160/275 |
| 6,701,994 | B2 * | 3/2004 | Goldenberg | E06B 9/54 | 160/120 |
| 6,814,127 | B2 * | 11/2004 | Tagtow | E06B 9/54 | 160/273.1 |
| 7,100,667 | B2 * | 9/2006 | Tomita | E06B 9/54 | 160/23.1 |
| 7,210,513 | B2 * | 5/2007 | Goldenberg | E06B 9/54 | 160/296 |
| 7,370,685 | B2 * | 5/2008 | Moriya | E06B 9/54 | 160/120 |
| 7,487,816 | B2 * | 2/2009 | Moriya | E06B 9/54 | 160/23.1 |
| 7,673,666 | B2 * | 3/2010 | Fan | E06B 9/262 | 160/84.04 |
| 7,861,761 | B2 * | 1/2011 | Martineau | E06B 9/54 | 160/31 |
| 8,011,413 | B2 * | 9/2011 | Poppema | E06B 9/54 | 160/23.1 |
| 8,528,623 | B2 | 9/2013 | Roberts | | |
| 8,656,978 | B2 * | 2/2014 | Goldenberg | E06B 9/56 | 160/31 |
| 9,351,599 | B2 * | 5/2016 | Roberts | A47H 5/03 | |
| 10,047,558 | B2 * | 8/2018 | Hummel | E06B 9/52 | |
| 10,920,488 | B2 * | 2/2021 | Toda | E06B 9/58 | |
| 10,947,779 | B2 * | 3/2021 | Hummel | E06B 9/52 | |
| 2001/0042346 | A1 * | 11/2001 | Brioschi | E06B 9/54 | 49/447 |
| 2002/0100562 | A1 | 8/2002 | Ikle | | |
| 2003/0033667 | A1 | 2/2003 | Lachance | | |
| 2005/0098276 | A1 * | 5/2005 | Agliolo Quartalaro | E06B 9/54 | 160/276 |
| 2007/0199667 | A1 * | 8/2007 | Jumbeck | A47H 99/00 | 160/274 |
| 2008/0210385 | A1 * | 9/2008 | Sawyers | E06B 9/54 | 160/31 |
| 2011/0114272 | A1 | 5/2011 | Roberts | | |
| 2016/0265275 | A1 * | 9/2016 | Rosell Rosell | E06B 9/58 | |
| 2019/0292846 | A1 * | 9/2019 | Conrad | E06B 9/78 | |
| 2020/0408037 | A1 * | 12/2020 | Roberts | E06B 9/42 | |

FOREIGN PATENT DOCUMENTS

| | | | |
|---|---|---|---|
| WO | WO-0169031 | A1 | 9/2001 |
| WO | WO-2001069031 | A1 | 9/2001 |
| WO | WO-2012006666 | A1 | 1/2012 |

* cited by examiner

SCREEN ASSEMBLY

CROSS-REFERENCE TO RELATED APPLICATIONS

This application is the National Stage of International Application No. PCT/AU2017/050756, filed Jul. 21, 2017, which claims the benefit of Australian Application No. 2016902857, filed Jul. 21, 2016. The contents of both applications are hereby incorporated by reference in their entirety.

FIELD

Various embodiments of a screen assembly are described herein.

SUMMARY

In one aspect, there is provided a screen assembly that comprises:

a support structure;

a roller assembly mounted on the support structure;

a flexible panel with a distal end mounted on the roller assembly so that the flexible panel can be wound on to and off the roller assembly as the flexible panel is retracted and extended;

two opposed track assemblies arranged on the support structure, sides of the flexible panel and each track assembly being configured so that the sides of the flexible panel can slide to and fro, longitudinally, within the track assemblies as the flexible panel is retracted and extended, at least one of the track assemblies having a static support that is fixed relative to the support structure and a dynamic support that is displaceable relative to the static support;

an adjustment mechanism that is operatively connected to the static and dynamic supports to adjust a position of the dynamic support relative to the static support;

an elongate guide assembly that is mounted on a proximal end of the flexible panel to guide movement of the flexible panel with respect to the track assemblies;

an insert mounted on at least one end of the guide assembly; and the dynamic support of said at least one of the track assemblies including a runner in which the insert is received to slide or roll with respect to the dynamic support as the flexible panel is retracted and extended.

At least one of the track assemblies may define a longitudinally extending guide formation, the guide assembly including at least one guide that is received in the guide formation to guide movement of the guide assembly with respect to the track assemblies.

The guide assembly may include a carrier that at least spans the flexible panel, the at least one guide being one guide that extends from one side of the carrier to be received in the guide formation that is defined by the static support and the insert extending from an opposite side of the carrier to be received in the runner.

The insert may be in the form of at least one wheel or roller, the, or each, roller and the runner being configured so that the, or each, roller can roll to and fro within the runner as the flexible panel is retracted and extended.

One of the track assemblies may have the static support and the dynamic support and the roller may be mounted on one end of the carrier that corresponds with said one of the track assemblies.

The guide assembly may further include at least one latch that can extend from at least one respective end of the carrier.

The, or each, latch can be extended or retracted with respect to the carrier to engage at least one respective track assembly.

The at least one latch may be connected to a corresponding at least one handle included in the guide assembly to enable extension or retraction of the, or each, latch upon operation of the handle.

One or more stoppers may be arranged in at least one of the track assemblies to form a stop for the, or each, latch when the, or each, latch is extended.

At least one of the dynamic support and the static support may include a bead guide on the end proximate the roller assembly.

The bead guide may define a channel containing at least one retaining formation with an internal slope to engage a bead of the flexible panel before being wound on to the roller assembly.

The support structure may include an elongate housing and two, opposed side members arranged at respective ends of the elongate housing, the roller assembly being mounted between the side members.

A bracket may be mounted on one of the side members to support a drive end of the roller assembly.

A guide member may be positioned on one of the side members and may be configured to guide an edge of the flexible panel as it is rolled onto the roller assembly, to inhibit coning of the flexible panel.

The support structure and the roller assembly may be configured for generally vertical orientation so that the flexible panel can extend generally horizontally.

The support structure may include a top side member and an opposed bottom side member, the roller assembly being mounted between the side members.

The opposed track assemblies may be an upper track assembly and a lower track assembly, the upper track assembly including the static and dynamic supports.

A guide member may be arranged on an inner side of the bottom side member and may be configured to guide an edge of the flexible panel as it is rolled onto the roller assembly to inhibit coning of the flexible panel.

At least one of the dynamic support and the static support may include a bead guide at or near an end proximate the roller assembly.

In another aspect, there is provided a screen assembly which comprises:

a support structure;

a roller assembly mounted on the support structure, the roller assembly including a drive roller and a mounting projection arranged on the drive roller to extend axially from a flange and radially with respect to a rotational centre of the drive roller to project radially from the drive roller; and a bracket that is mounted on the support structure, the bracket defining a receiving formation for receiving one end portion of the roller, the bracket including a bracket body and a releasably engaged closure that together define the receiving formation, the closure being configured to retain the mounting projection and thus the roller against radial movement when engaged and, when released, to permit the mounting projection and thus the drive roller to be displaced from the bracket body and out of the formation in a radial demounting direction.

The formation for receiving one end portion of the roller may be in the form of a circular opening and a peripheral, internal lip, both defined by the bracket body and the closure so that the mounting projection is retained in the opening by the lip.

A drive mechanism may be mounted on the bracket and may be operatively engaged with the drive roller to permit a user to rotate the drive roller.

The mounting projection may be in the form of at least one tooth of a gear, the drive mechanism including a gear wheel that is received in the opening, the gear wheel defining a slot to receive the, or each, tooth so that the gear wheel and the, or each, tooth complete the gear wheel.

The drive mechanism may include an input gear that is engaged with the gear wheel and accessible from outside the bracket, the input gear being configured for manipulation by the user.

The input gear may be in the form of a worm gear located in a passage defined in the bracket body, the passage being in tangential communication with the opening so that the worm gear can engage the gear wheel.

In another aspect, there is provided a screen assembly that comprises:

first and second opposed support structures;

two opposed track assemblies that are mounted between the support structures and spaced so that the support structures and the track assemblies define an opening;

first and second roller assemblies mounted in respective first and second support structures, each roller assembly including a biasing mechanism;

a flexible panel, a distal end of the flexible panel being mounted on the first roller assembly so that the flexible panel can be wound off the first roller assembly against a bias of the biasing mechanism and back on to the first roller assembly under action of the biasing mechanism;

a handle assembly that is mounted on a proximal end of the flexible panel and displaceable in an opening direction towards the first roller assembly and a closing direction away from the first roller assembly;

at least one pulley that is mounted on the second roller assembly, a flexible connector with a distal end being connected to the pulley so that unwinding of the connector from the pulley occurs against a bias of the biasing mechanism and winding of the connector back onto the pulley is under action of the biasing mechanism, a proximal end of the connector being connected to the handle assembly so that movement of the handle assembly in the opening direction is against a bias of the second roller assembly and movement of the handle assembly in the closing direction is assisted by the bias of the second roller assembly; and a stop arrangement that is operatively arranged with respect to the support structures and the handle assembly and operable to selectively stop the handle assembly in a desired position relative to the support structures.

At least one of the roller assemblies may include an adjustment mechanism to adjust the biasing mechanism.

The handle assembly may include a latch mechanism that forms part of the stop arrangement, which includes one or more stoppers that are positioned in the support structures to engage the latch mechanism.

In another aspect, there is provided a screen assembly that comprises:

a support structure that includes an elongate housing and two, opposed side members arranged at respective ends of the elongate housing;

a roller assembly mounted on the support structure between the side members;

a flexible panel with a distal end mounted on the roller assembly so that the flexible panel can be wound on to and off the roller assembly as the flexible panel is retracted and extended; and a guide member that is positioned on one of the side members and configured to guide an edge of the flexible panel as it is rolled onto and off the roller assembly to inhibit coning of the flexible panel.

The support structure and the roller assembly may be configured for generally vertical orientation so that the flexible panel can extend generally horizontally.

The support structure may include a top side member and an opposed bottom side member, the roller assembly being mounted between the side members and the guide member being positioned on the bottom side member.

A bead guide may be mounted on the bottom side member, the bead guide being configured to guide an edge of the flexible panel as it is rolled onto and off the roller assembly.

Two opposed track assemblies, in the form of an upper track assembly extending from the top side member, and a lower track assembly extending from the bottom side member, may be arranged on the support structure, the upper track assembly including a bead guide proximate the roller assembly, the bead guide being configured to guide an edge of the flexible panel as it is rolled onto and off the roller assembly.

The bead guide may define a channel containing at least one retaining formation with an internal slope to support a bead of the flexible panel before being wound on to the roller assembly.

DESCRIPTION OF EMBODIMENTS

Figure 1:
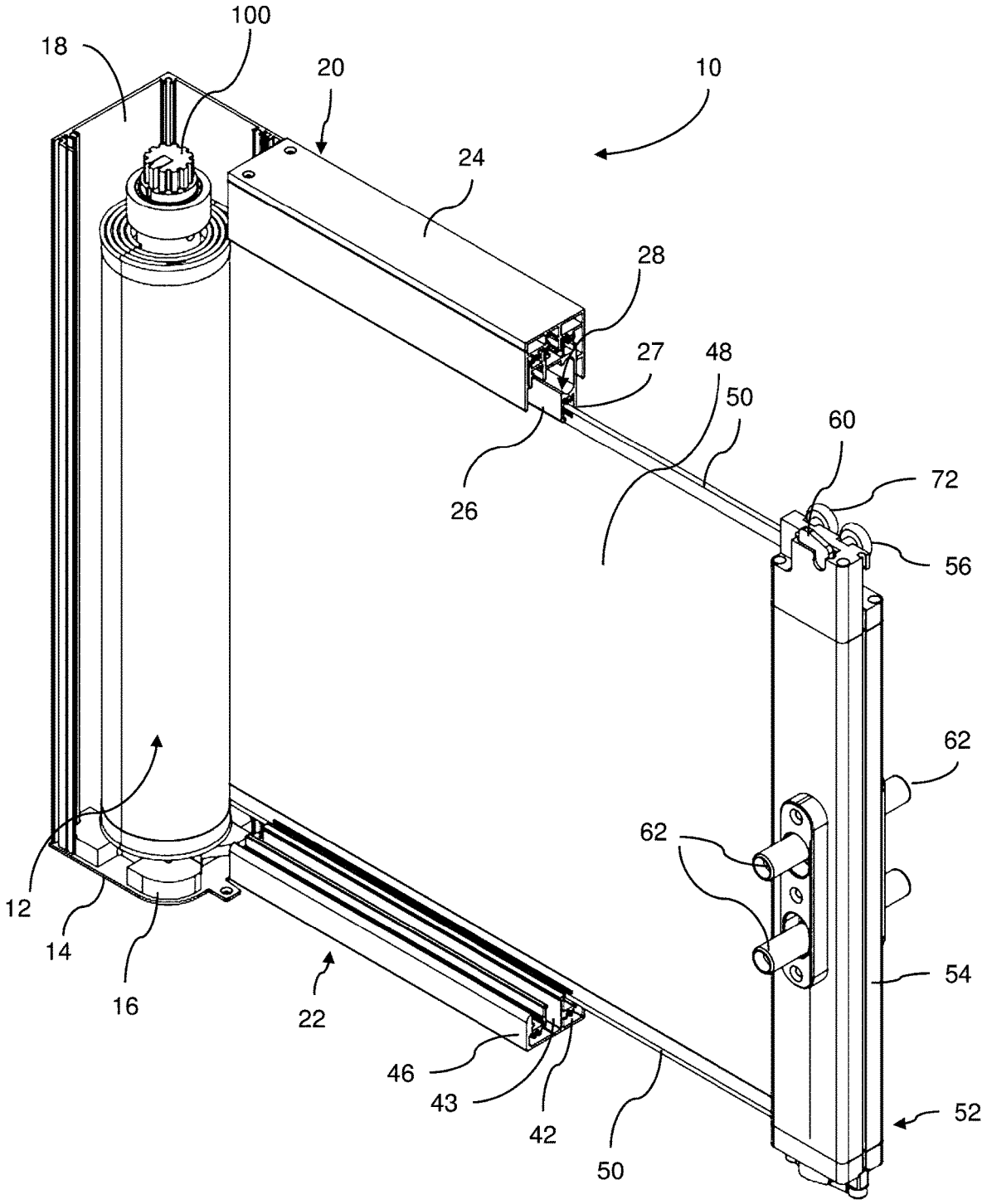
FIG. 1 is a front perspective view of a screen assembly according to an embodiment of the present disclosure with covers and other components removed to show detail.

FIG. 1 shows a front perspective view of a screen assembly generally indicated by reference numeral 10. Several components have been removed for ease of description in this drawing.

Figure 5:
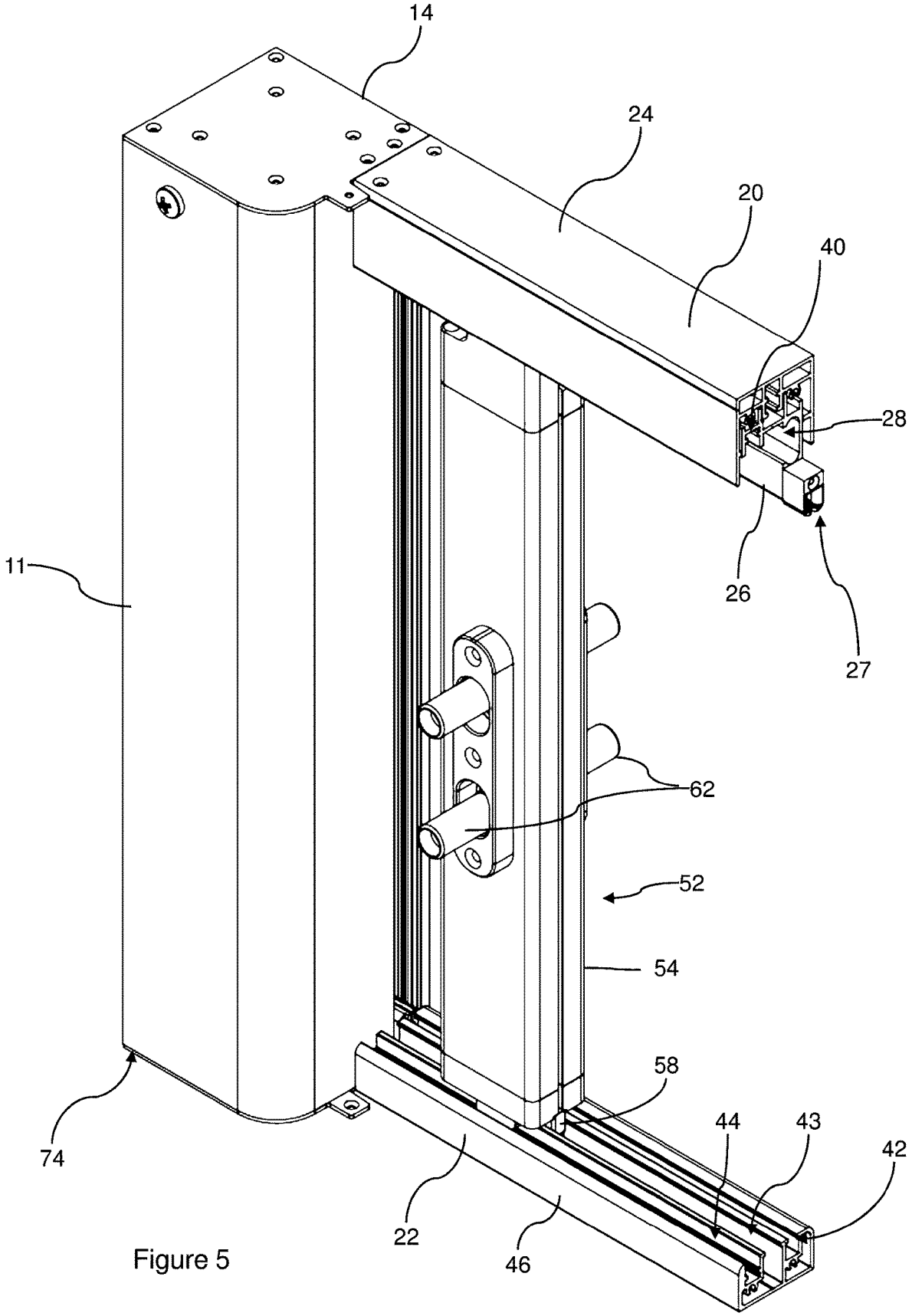
FIG. 5 is a front view of the screen assembly showing a cutaway of the adjustable and static track assemblies.

The screen assembly 10 has a roller assembly 12 that is mounted on a support structure in the form of an elongate housing in the form of a cassette housing 11 (FIG. 5). The cassette housing 11 includes a pair of opposed side plates 14. A bracket 16 is mounted on one of the side plates 14 and supports a drive end of the roller assembly 12.

The cassette housing 11 includes a backplate 18. The assembly 10 includes two opposed track assemblies. The track assemblies include an adjustable, elongate track assembly 20 mounted on and extending from one side of the backplate 18. A static track assembly 22 is mounted on and extends from an opposite side of the backplate 18.

Figure 2:
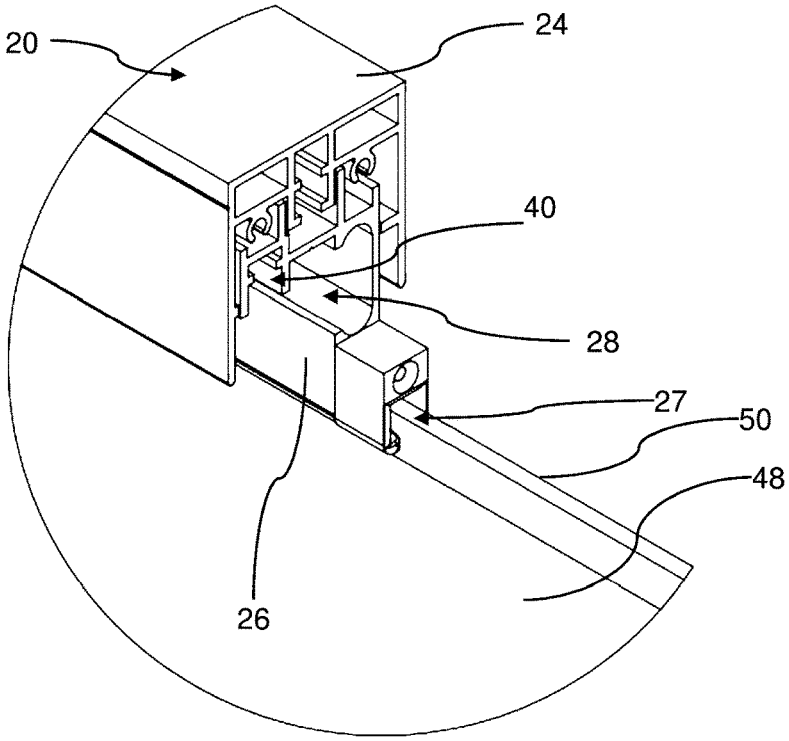
FIG. 2 is a front, cutaway view of an operatively upper part of the screen assembly showing an adjustable track assembly of the screen assembly.
Figure 3:
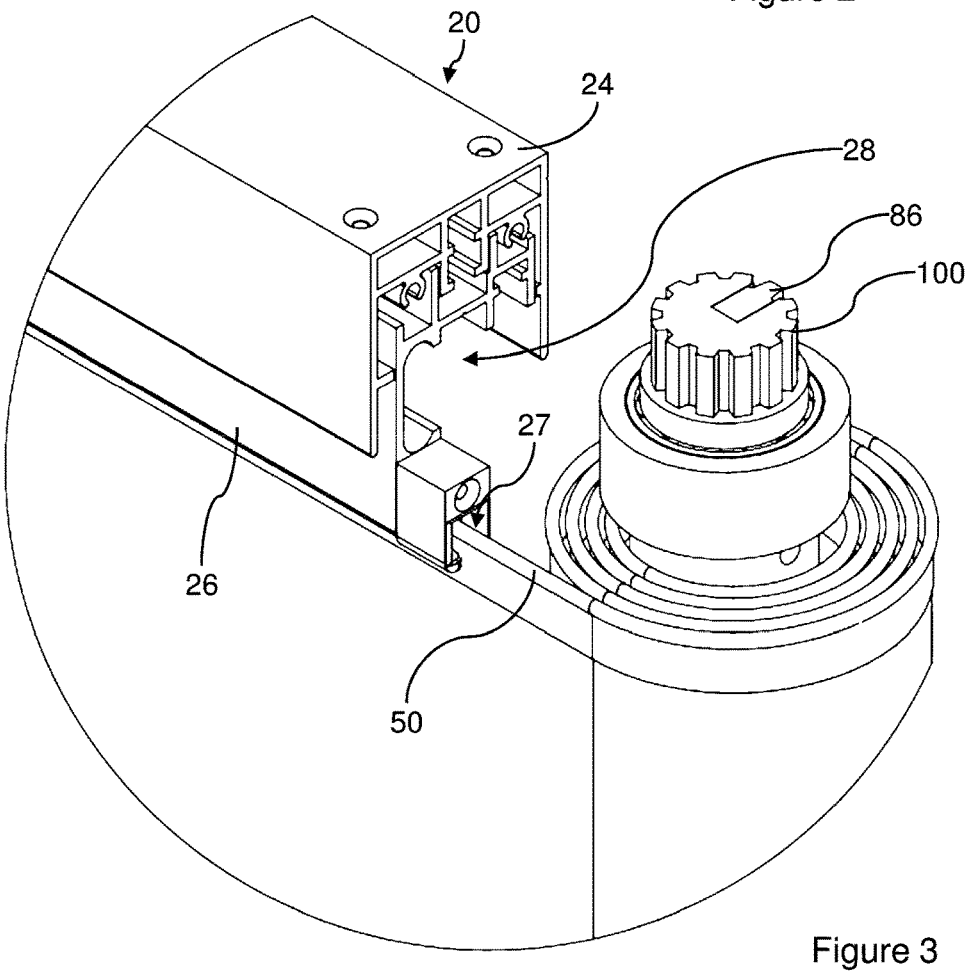
FIG. 3 is a rear, cutaway view of part of the screen assembly showing the adjustable track assembly.
Figure 4:
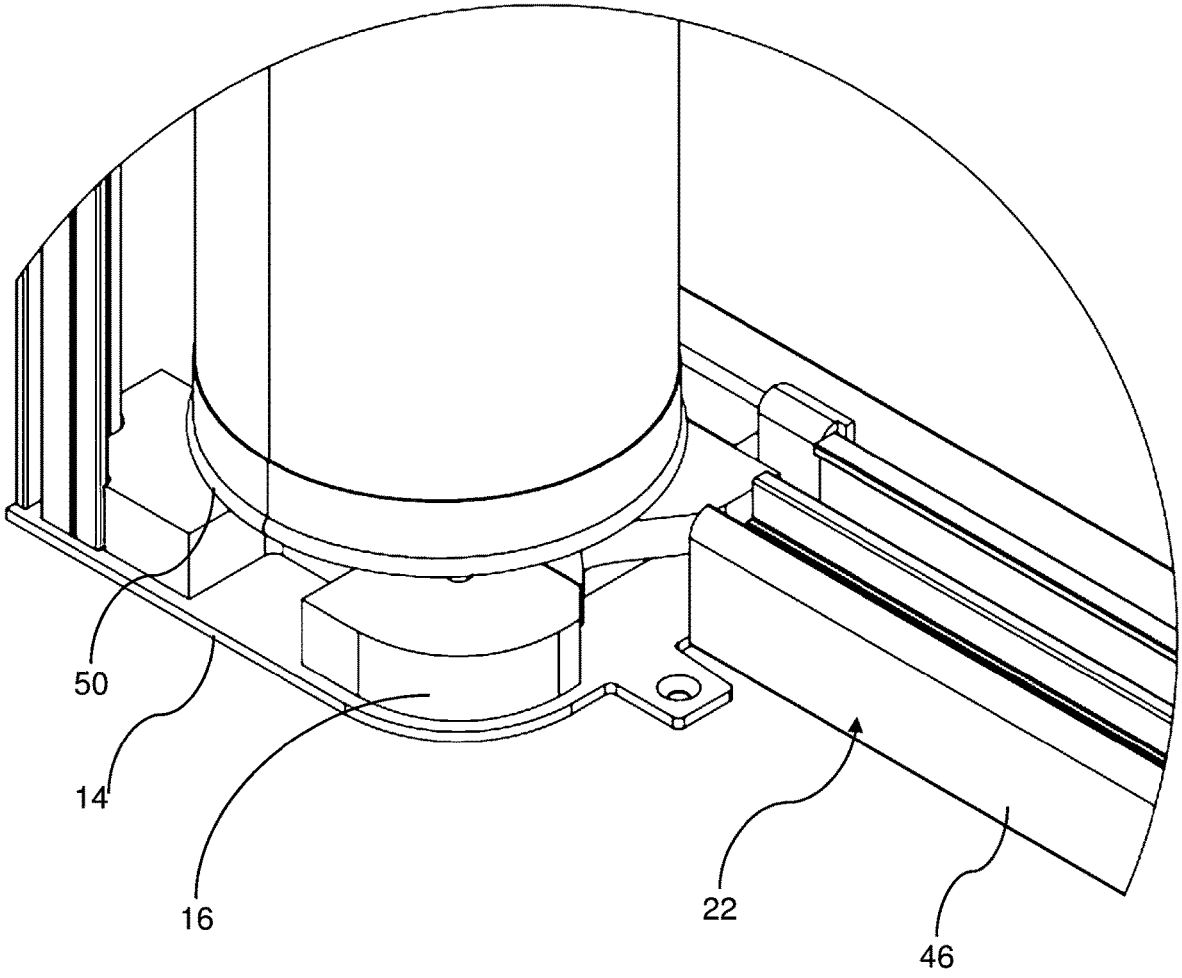
FIG. 4 is a front view of an operatively lower part of the screen assembly showing a static track assembly of the screen assembly.

The adjustable track assembly 20 includes an elongate static support 24 and a dynamic elongate support 26. The static support 24 is fixed relative to the support structure. The dynamic support 26 is displaceable relative to the support structure, for adjustment. The dynamic support 26 is adjustable relative to the static support 24 along a line perpendicular to a longitudinal axis of the static support 24. The dynamic support 26 includes a bead or zip track 27 and a runner 28 positioned laterally outwardly with respect to the track 27. Detail of the zip track 27 and the runner 28 can be seen in FIGS. 2 and 3.

The zip track 27 is dimensioned to receive a zip or bead of a flexible panel, an example of which is described below.

Figure 6:
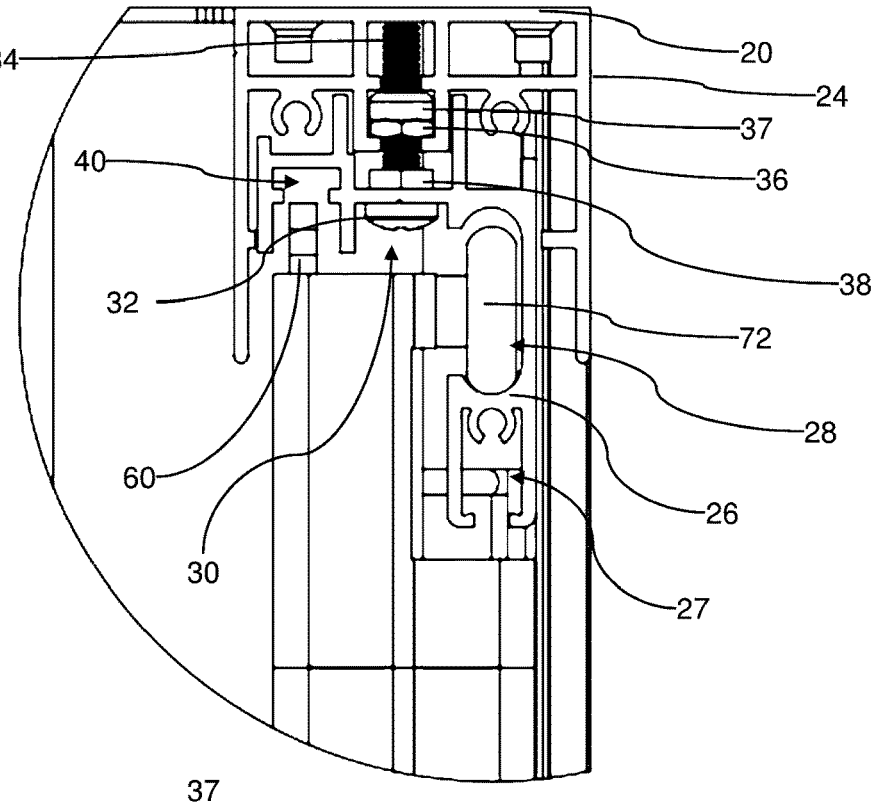
FIG. 6 is a schematic plan view of the adjustable track assembly.
Figure 7:
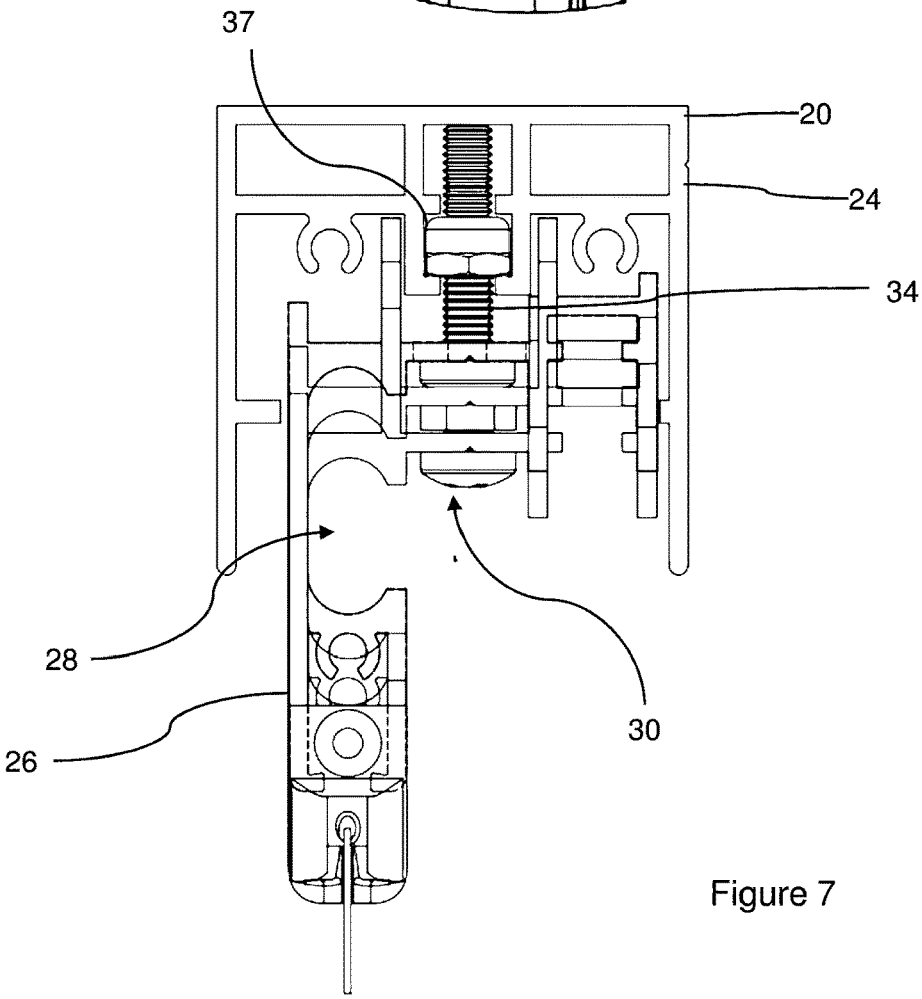
FIG. 7 is a schematic plan view of the adjustable track assembly showing adjustment of the adjustable track assembly.
Figure 8:
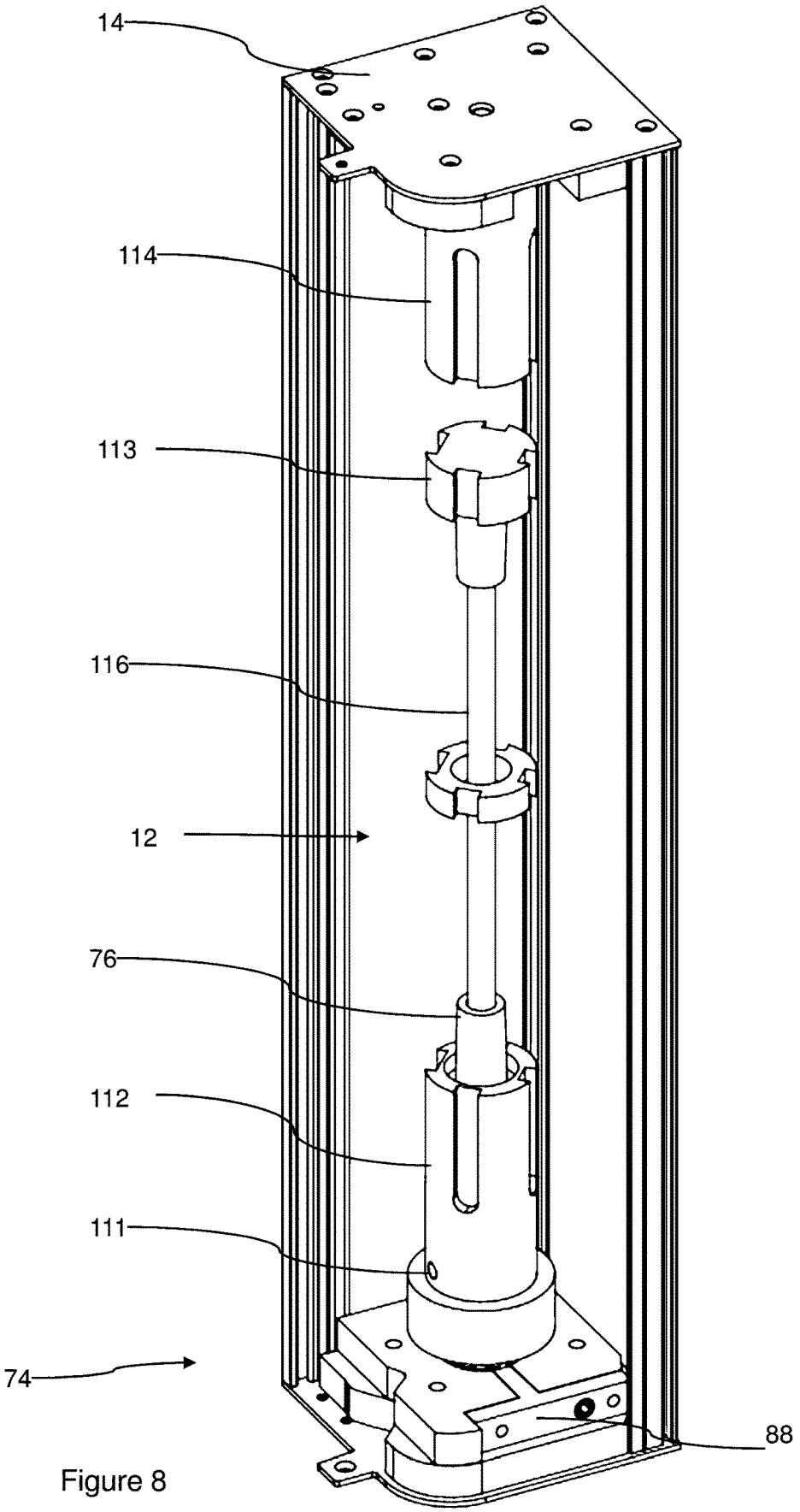
FIG. 8 is a perspective view of part of a roller assembly in an open cassette of the screen assembly.
Figure 10:
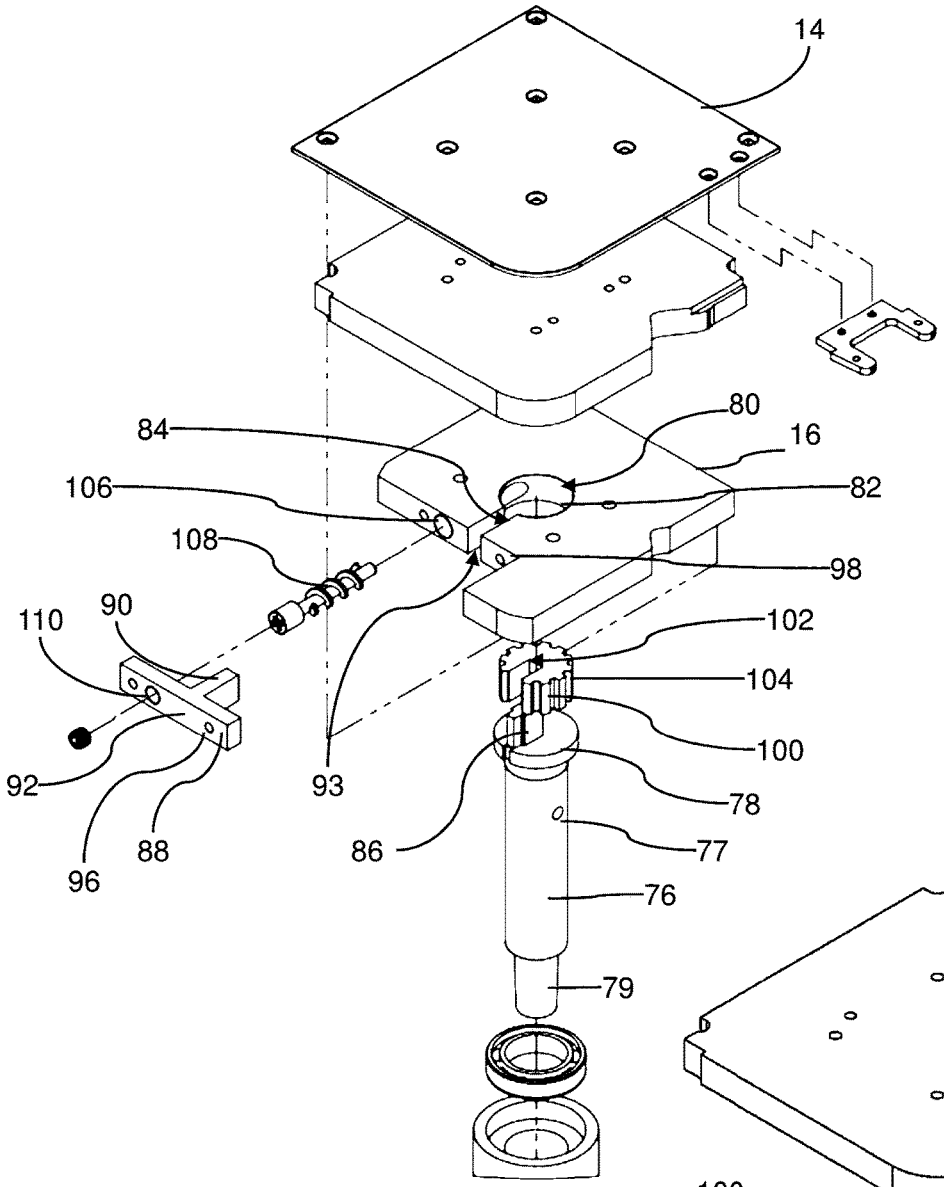
FIG. 10 is an exploded view of the drive assembly of the roller assembly.
Figure 9:
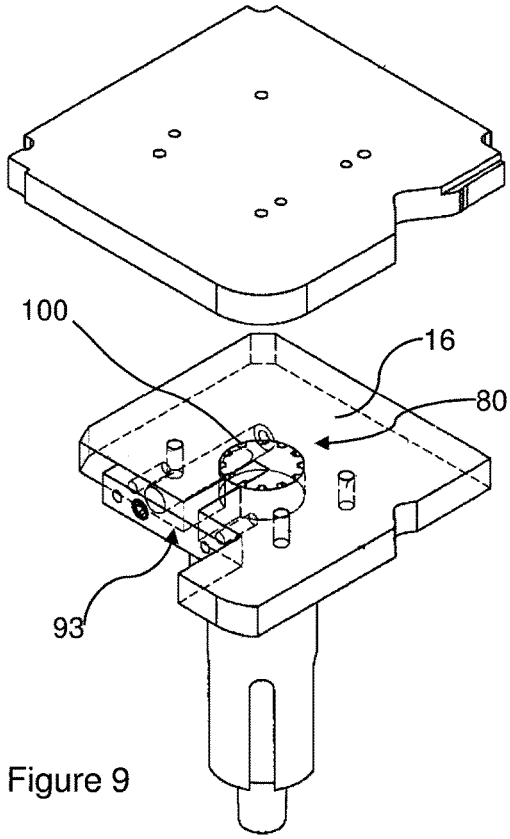
FIG. 9 is a partly perspective view, with hidden detail, of a drive assembly of the roller assembly.

An adjustment mechanism 30 is interposed between the static and dynamic supports 24, 26 and is operable to adjust the static and dynamic supports 24, 26 relative to each other. Detail of the adjustment mechanism 30 can be seen in FIGS. 6 and 7. FIG. 7 shows three positions for the dynamic support 26 as it is adjusted using the mechanism 30. The adjustment mechanism 30 includes an adjustable head 32 and a threaded shank 34 extending from the head 32. The shank 34 extends through part of the dynamic support 26 with the head 32 bearing against an inward surface of said part. A nut, for example a torque nut 36, is trapped in a channel or recess 37 defined by part of the static support 24 with the shank 34 threaded through the nut 36. A further nut in the form of a torque nut 38 is threaded onto the shank 34 such that said part of the dynamic support 26 is trapped between the head 32 and the nut 38. Thus, rotation of the head 32 can result in inward and outward movement of the dynamic support 26 relative to the static support 24. The head 32 can define a suitable engagement formation for a conventional tool so that the adjustment mechanism 30 can be manipulated.

The static support 24 includes a runner 28 for receiving a guide of a latch assembly, and a guide formation 40 for receiving a latch of a latch assembly, both as described below.

The static and dynamic supports 24, 26 are both of an extruded material. The extruded material can be a plastics material or a metal, such as aluminium or an aluminium alloy. It is envisaged that the static and dynamic supports 24, 26 can be fabricated in other ways, such as by injection moulding or machining.

The static track assembly 22 includes a bead or zip track 42 for slidably receiving a bead or zip of a flexible panel, an example of which is described below. The zip track 42 is dimensioned so that the bead or zip has a certain extent of play when sliding within the zip track 42.

The static track assembly 22 includes a guide formation 43 for receiving a guide of the latch assembly, as described below.

The static track assembly 22 includes a static support 46. The static support 46 can be of an extruded material to define the guide formation 43 and the zip track 42 or a channel for an insert that defines the zip track 42, and a guide formation 44 for receiving a latch of a latch assembly.

The screen assembly 10 includes a flexible panel 48 such as a screen or blind, for example, a fly screen, sunscreen, block out blind, or privacy screen made of any suitable material including fabric, that is fastened to the roller assembly 12 at a fixed or distal end to be wound onto the roller assembly 12. The panel 48 can be wound onto and off the roller assembly as the flexible panel is retracted and extended. Thus, the panel 48 can be unwound from the roller assembly 12 to extend the flexible panel 48 and rewound to retract the flexible panel 48. The panel 48 includes a bead or zip 50 on each side. The beads 50 are received in the respective tracks 27, 42 so that the panel 48 spans an area between the adjustable and static track assemblies 20, 22. It will thus be appreciated that adjustment of the static and dynamic supports 24, 26 relative to each other using the adjustment mechanism 30, in the manner described above, can be used to adjust a tension within the panel 48. In use, with the roller assembly 12 in a horizontal configuration, it will be understood that, over time, the upper track assembly could bow, causing the panel to become unsightly and the guide assembly (described below) to drop, go out of vertical orientation and thus out of alignment and possibly dragging or scraping on the lower track assembly. That would be noisy and could cause damage. The ability to adjust a relative position of the static and dynamic supports 24, 26 allows this problem to be corrected or avoided. Furthermore, the fact that the bead or zip of the flexible panel is engaged with the upper track assembly along its length allows for the panel to be supported fully along its length, in full or partial extraction, without the need to maintain a tension in that edge with the use of cables or the like. Such cables or the like can stretch or break over time, causing the guide assembly to drop and/or go out of alignment with the subsequent problems mentioned above.

An elongate guide assembly 52 is mounted on a movable or proximal end of the panel 48. In this embodiment, the elongate guide assembly 52 is in the form of a latch assembly. The latch assembly 52 can be similar to the "locking rail assembly" as described in Australian patent number 2011279538, the contents of which are entirely incorporated herein by reference. Furthermore, in this specification, the word "proximal" is used to define that side or part of a component that is closest to a user, in use. For example, in this embodiment, the latch assembly 52 will be closer to the user than the roller assembly. The word "distal" has an opposite meaning.

The latch assembly 52 includes an elongate carrier or latch housing 54, with the movable or proximal end of the panel 48 being positioned between ends of the housing 54. A guide in the form of a first guide formation 56 extends from one end of the housing 54 to slide in the runner 28. A guide in the form of a second guide formation 58 extends from an opposite end of the housing 54 to slide in the guide formation 43. The guide formations serve to guide movement of the guide assembly with respect to the track assemblies.

The latch assembly 52 includes latches 60 that extend from respective ends of the housing/carrier 54. Handles 62 are connected to respective latches 60 so that the latches 60 can be extended or retracted with respect to the housing 54 upon operation of the handles 62.

Any number of stoppers, one of which is indicated at 66 (FIG. 13) are mounted on an internal surface 64 of the guide formations 40 and/or 44 The stoppers 66 are positioned to form a stop for the latches 60 when the latches 60 are extended. Thus, the latch assembly 52 can be locked in a position with respect to the roller assembly 12 depending on a position of the stoppers 66. Thus, in the example of a spring-mounted retractable screen, the stoppers 66 can be used to inhibit full retraction when the latches 60 are extended. It will be appreciated that a number of the stoppers 66 can be used to achieve desired positions of the latch assembly 52 and thus the flexible panel 48 when the latches 60 are extended. Each stopper 66 is mounted on the surface 64 with a stopper plate 68. The stopper 66 has a ramped surface 70 to engage the latch 60.

An insert is mounted on one end of the guide assembly and is received in the runner 28 to slide or roll with respect to the dynamic support 26 as the flexible panel 48 is retracted and extended. In this example, the insert is a roller in the form of two guide wheels 72 rotatably mounted on the latch housing 54 to be received in the runner 28 so that the wheels 72 can roll to and fro within the runner 28. It is envisaged that a single guide wheel may be also be suitable.

In this embodiment, the adjustable assembly 20 is mounted above the static track assembly 22. Thus, the wheels 72 bears a weight of the flexible panel 48 and the latch assembly 52. It will be appreciated that this results in a significant reduction in friction when compared to a situation in which a conventional slider within a runner is bearing the weight.

Figure 11:
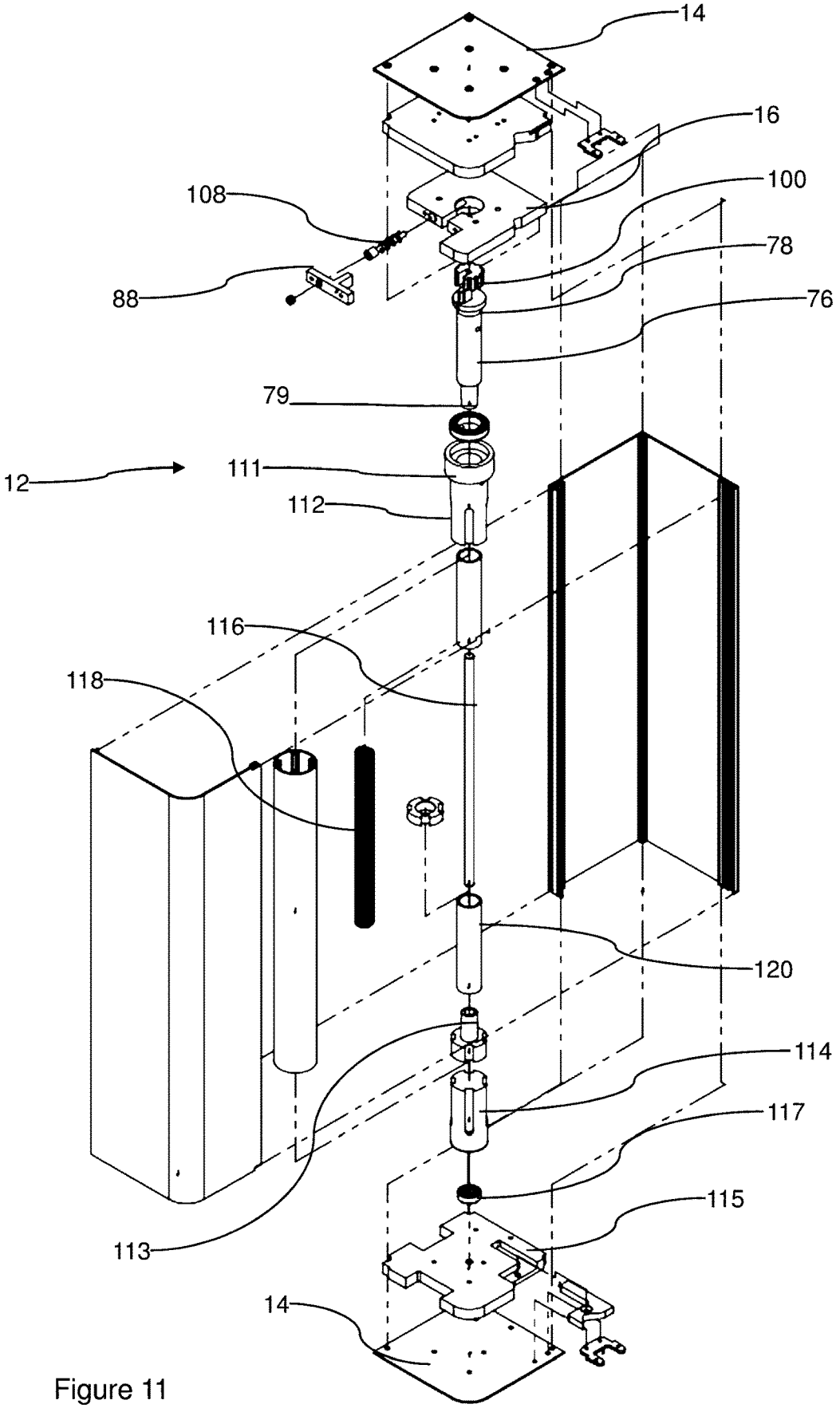
FIG. 11 is an exploded technical drawing of a cassette for the screen assembly of FIG. 1.

In use, an effective lateral position of the wheels 72 in relation to the static support 24 can be adjusted with the adjustment mechanism 30. Thus, movement of the panel 48 and latch assembly 54 can be tuned to achieve as smooth a movement as possible. More particularly, over time, the adjustable track assembly 20 might bow as a result of the weight referred to above. This could result in the bead 50 rubbing against an internal surface of the track 42 of the static track assembly 22. Even worse, this could result in the latch assembly 52 scratching against the track 42 causing noise and damage. The extent of play referred to above allows the dynamic support 26 to be shifted upwardly to lift the bead 50 away from the internal surface of the track 42 and the latch assembly 52 away from the track 42 to avoid such rubbing and scratching. It will therefore be appreciated that during to and fro movement of the panel 48, contact can be limited to a zone between the guide wheels 72 and the runner 28. As a result, wear related to friction is kept to a minimum. The extent of play referred to above can be between about 8 mm and 9 mm. However, this will vary depending on various factors, such as a size of the screen assembly 10. Detail of the roller assembly 12 is shown in FIGS. 8 to 10 and 11. FIG. 11, in particular, shows an exploded view of a cassette 74 that includes the roller assembly 12.

The roller assembly 12 includes a drive roller 76. A drive bracket or flange 78 is arranged on a drive end of the drive roller 76. The bracket 16 defines a circular opening 80 in which the flange 78 is positioned. The bracket 16 further defines an internal, peripheral lip 82. The bracket 16 also defines a slotted gap 84 that provides radial access to the opening 80 from a position outside of the bracket 16.

A projection in the form of a gear tooth 86 extends axially from the flange 78 and radially with respect to a rotational centre of the flange 78 to project radially from the flange 78. The tooth 86, the gap 84 and the lip 82 are dimensioned so that, when the flange 78 is brought into abutment with the lip 82, the tooth 86 can be received through the gap 84. The extent of overhang of the tooth 86 permits the tooth 86 to slide over, and be supported by, the lip 82 when the drive roller 76 is rotated. Thus, the tooth 86 is configured so that, as the drive roller 76 rotates, the tooth 86 can rotate into and out of register with the gap 84. The tooth 86 and the gap 84 are dimensioned so that, when the tooth 86 is in register with the gap 84, the tooth 86 can move radially out of the opening 80 to allow the roller assembly 12 to be removed from the bracket 16.

The bracket 16 includes a closure 88 for closing the gap 84. The closure 88 is detachable so that it can be removed when it is required to remove the drive roller 78 from the bracket 16. The closure 88 is generally T-shaped with a leg 90 being received in the gap 84 to close the gap 84. The leg 90 is configured so that the opening 80 has a continuous periphery when the gap is closed allowing for smooth rotation of the tooth 86 within the opening 80. A crossbar 92 of the closure 88 is received in a recess 93 defined by the bracket 16 and can be fastened with a fastener to the bracket 16.

A gear wheel 100 is received in the opening 80 to bear against the lip 82. The gear wheel 100 has a slot 102 that is configured and dimensioned to accommodate the tooth 86. The gear wheel 100 has teeth 104, each of which are substantially identical to the tooth 86. Thus, when the gear wheel 100 is received in the opening 80, the gear wheel 100 and the tooth 86 define a complete gear wheel.

The bracket 16 defines an internal passage 106 that is in tangential communication with the opening 80. A drive gear in the form of a worm gear 108 is positioned in the internal passage 106 to engage the gear wheel 100 and tooth 86. The passage 106 opens into the recess 93. The crossbar 92 defines an opening 110 that is in register with the passage 106 so that, when the closure 88 is in position, the worm gear 108 can be accessed with a suitable tool to rotate the gear wheel 100 and thus the drive roller 76.

The drive roller 76 defines an opening 77 that can be used to receive a locking device to lock a spring, referred to below, during disassembly. This will avoid the need to pre-tension the spring subsequent to assembly.

The drive roller 76 defines a spring mount 79 to receive a spring 118, described below.

The roller assembly 12 can include various other components to complete itself. Examples of these are shown in FIG. 11. A drive collar 112 is mounted on the drive roller 76 and is rotatable relative thereto. The drive collar 112 also has an opening 111 that can align with the opening 77 so that the drive collar 112 and the drive roller 76 can be locked together with a suitable tool received through the openings 77, 111 to maintain a tension in the spring 118. The spring 118 is a torsion spring with coils and an internal passage. One end of the spring 118 is mounted on the spring mount 79. The roller assembly 12 includes a tube drive 113 onto which an opposite end of the spring 118 is mounted.

A roller tube 120 is positively engaged with the drive collar 112 and the tube drive 113, via suitable complementary formations. It follows that, as the roller tube 120 rotates while the panel 48 is extracted, the drive collar 112 and the tube drive 113 rotate independently of the drive roller 76. This results in the build-up of tension within the spring 118 so the spring 118 can retract the panel 48 when the latches 60 are released from the stoppers 66.

A bearing tube collar 114 is also positively engaged with the roller tube 120 and is rotatably mounted on an inner cap 115, via a suitable bearing 117. Thus, rotation of the roller tube 120 during extraction and retraction of the flexible panel 48 is accommodated by relative rotation of the drive collar 112 and the roller 77, on one side, and relative rotation of the bearing tube collar 114 and the inner cap 115, on the other side.

The drive roller 76 rotates independently of the collar 112. The collar 112 is locked to the roller 76 with a pin received through holes 111 and 77 so that the spring tension can be maintained when dismantling or reinstalling. This prevents the spring 118 from unwinding and having to be tensioned again.

A rod 116 is positioned within the spring 118 to stabilise the spring 118.

Thus, as the panel 48 is unwound, the spring 118 is tensioned such that retraction of the panel 48 is facilitated. Access to the worm gear 108 allows the user to rotate the drive roller 76 to allow the spring 118 to be pre-tensioned or pre-released to adjust the effort required to extend the panel 48 or to adjust a retracting torque applied by the spring 118.

Removal of the closure 88 and rotation of the gear wheel 100 with the worm gear 108 allows a user to remove the drive roller 76 and thus the remaining components in a radial direction. This avoids the need to dismantle the roller assembly 12 in an axial direction. Axial dismantling can be difficult, particularly in a confined area.

It is to be appreciated that the tooth 86 can be a projection that fits within a slot defined by a disc or other rotating member. In that case, the drive roller 76 can be rotated in some other way, for example, with drive access from an axial side of the drive roller 76, which still limits the extent of work required on the axial side since the drive roller 76 will still drop out radially with respect to the opening 80.

The gear wheel 100 is an output gear. The output gear may not necessarily be a conventional gear wheel and can take a number of different forms, for example, selected from a group including a bevel gear, a cage gear, a double helical gear, a helical gear, a hyphoid gear, a skew gear, a spiral bevel gear, a spur gear, or a sun and planet gear. In each case, an input gear other than the worm gear 108 can be appropriately configured to engage the output gear.

In FIGS. 11 to 18, there are shown various examples of parts of the screen assembly 10 for the purposes of fabrication.

The components of FIG. 11 have been described to some extent already. This drawing is not intended to be limiting. In this case, the cassette assembly is of the type that allows unwinding of a blind or screen against a tension of a spring. The latch assembly can then be used to lock the blind or screen in a desired position.

In a different example, the cassette assembly can be of the type in which the screen is drawn or extracted and locks automatically. As is known, with such mechanisms, the screen is released by drawing it slightly to disengage a locking mechanism and then released so that the spring can rewind the flexible panel. In a further example, the cassette assembly can be of the type in which the flexible panel is either unwound or rewound manually. In any of the examples, the manner in which the roller assembly is mounted, as described above, allows the roller assembly to be removed in a radial direction without the need to access the roller assembly from an axial direction or to remove the roller assembly in the axial direction.

Figure 12:
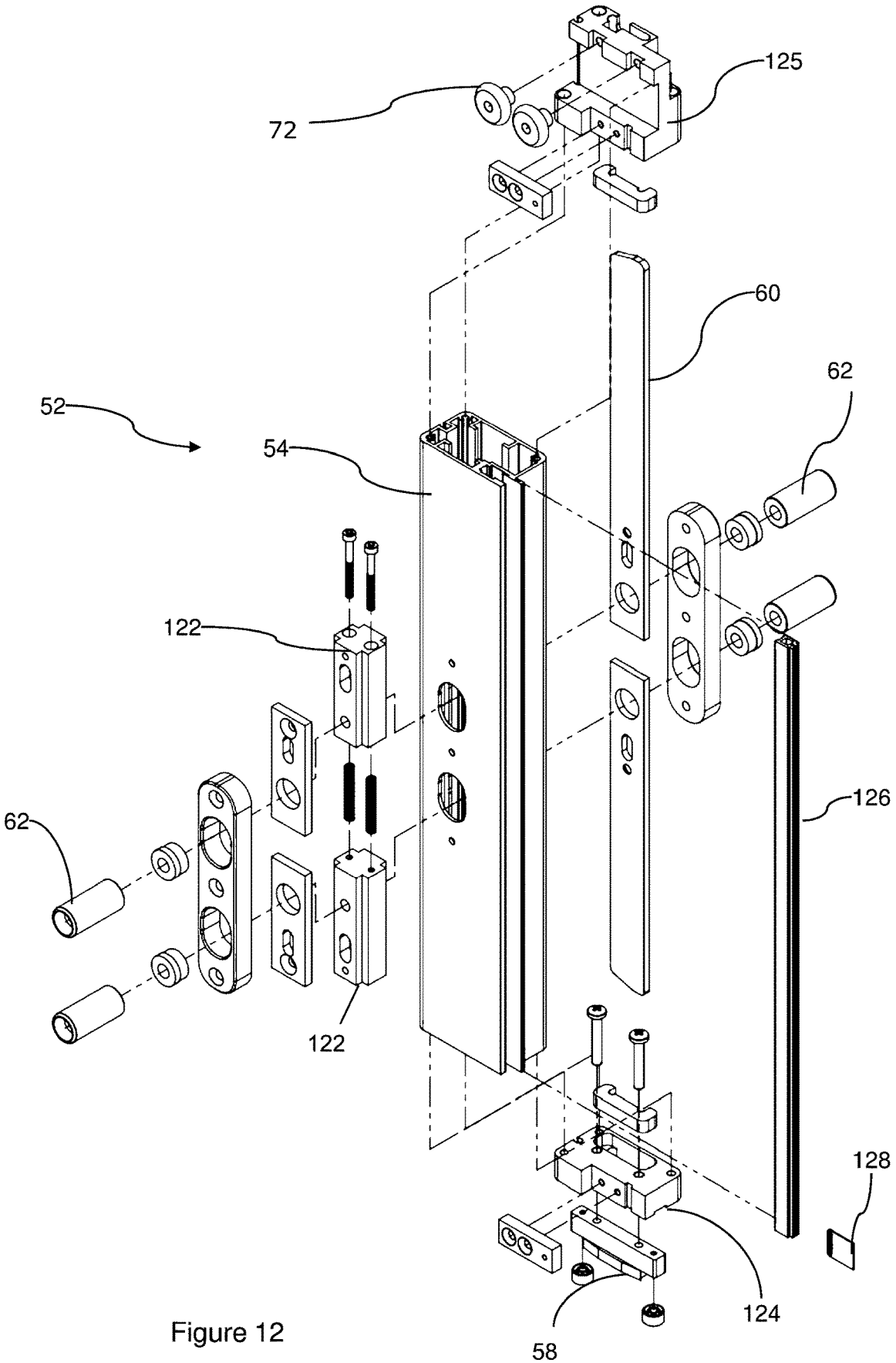
FIG. 12 is an exploded technical drawing of a latch assembly for the screen assembly of FIG. 1.

The components of the latch assembly shown in FIG. 12 include latch blocks 122 to facilitate engagement of the handles 62 with the latches 60. The latch assembly 52 includes a latch housing 54. An end cap 124 that defines the guide formation 58 is mounted on one end of the latch. A wheel mount 125 is mounted on an opposite end of the latch housing 54. The guide wheels 72 are mounted on the wheel mount 125.

Furthermore, the assembly 52 includes an insert 126 positioned along a length of the housing 54. The insert 126 is configured to engage the proximal edge of the panel 48 by means of a zip 128.

Figure 13:
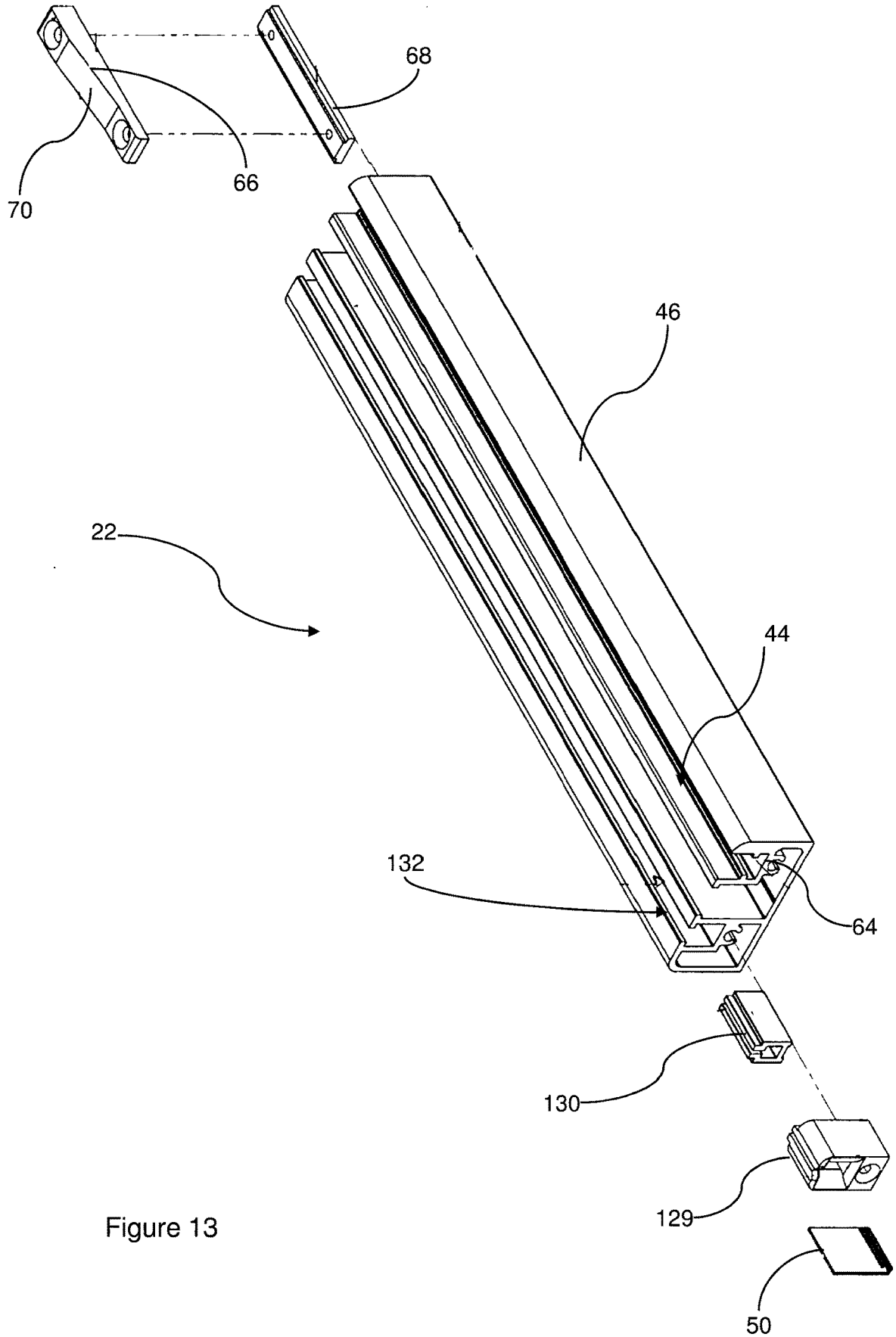
FIG. 13 is an exploded technical drawing of a static track assembly for the screen assembly of FIG. 1.

The components of the static track assembly 22 shown in FIG. 13 have been described to some extent already. FIG. 13 also shows a zip feeder 129 that is used to feed the zip or bead 50 into the track 42. The track 42 is defined by an insert 130, for example of a plastics material, such as PVC, or aluminium, or any other appropriate material, that is received in a channel 132 defined by the static support 46.

Figure 14:
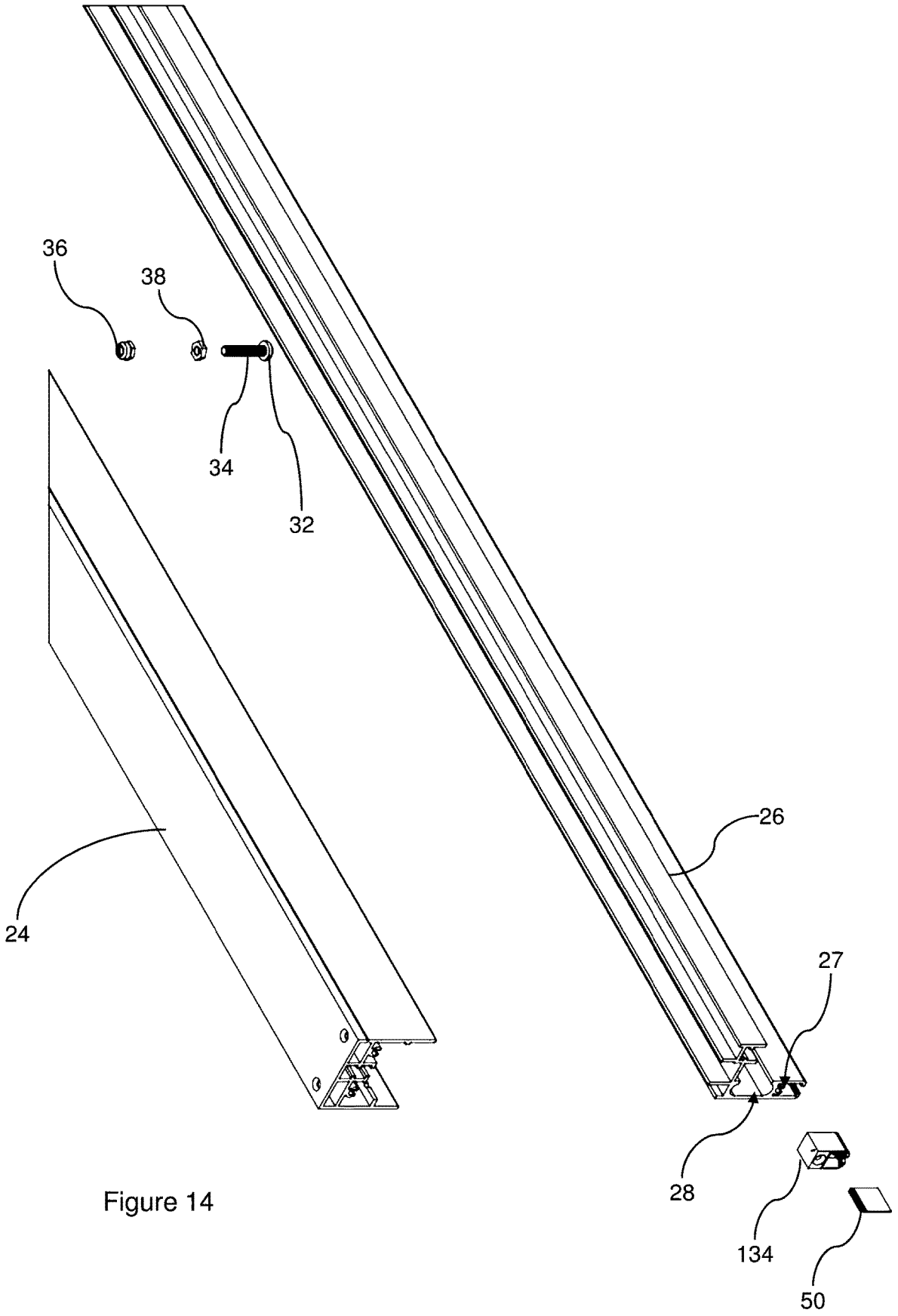
FIG. 14 is an exploded technical drawing of an adjustable track assembly for the screen assembly of FIG. 1.

The components of the adjustable track assembly 20 shown in FIG. 14 have been described to some extent already. FIG. 14 shows a zip feeder 134 that is used to feed the zip or bead 50 into the track 27.

It is to be understood that the screen assembly 10 can be used in a number of different orientations. For example, the cassette 74 can be positioned vertically so that the panel 48 can be fed horizontally. In another example, the cassette 74 can be positioned so that the panel 48 is extracted upwardly, rather than downwardly. Particularly in the horizontal orientation of the panel 48, the adjustable track assembly 20 is positioned above the static track assembly 22. In that configuration, the guide wheels 72 serve to provide a smooth operation and friction avoidance since the guide wheels 72 can bear the weight of the panel 48 and the latch assembly 52 rather than that weight being borne by a frictional.

Figure 15:
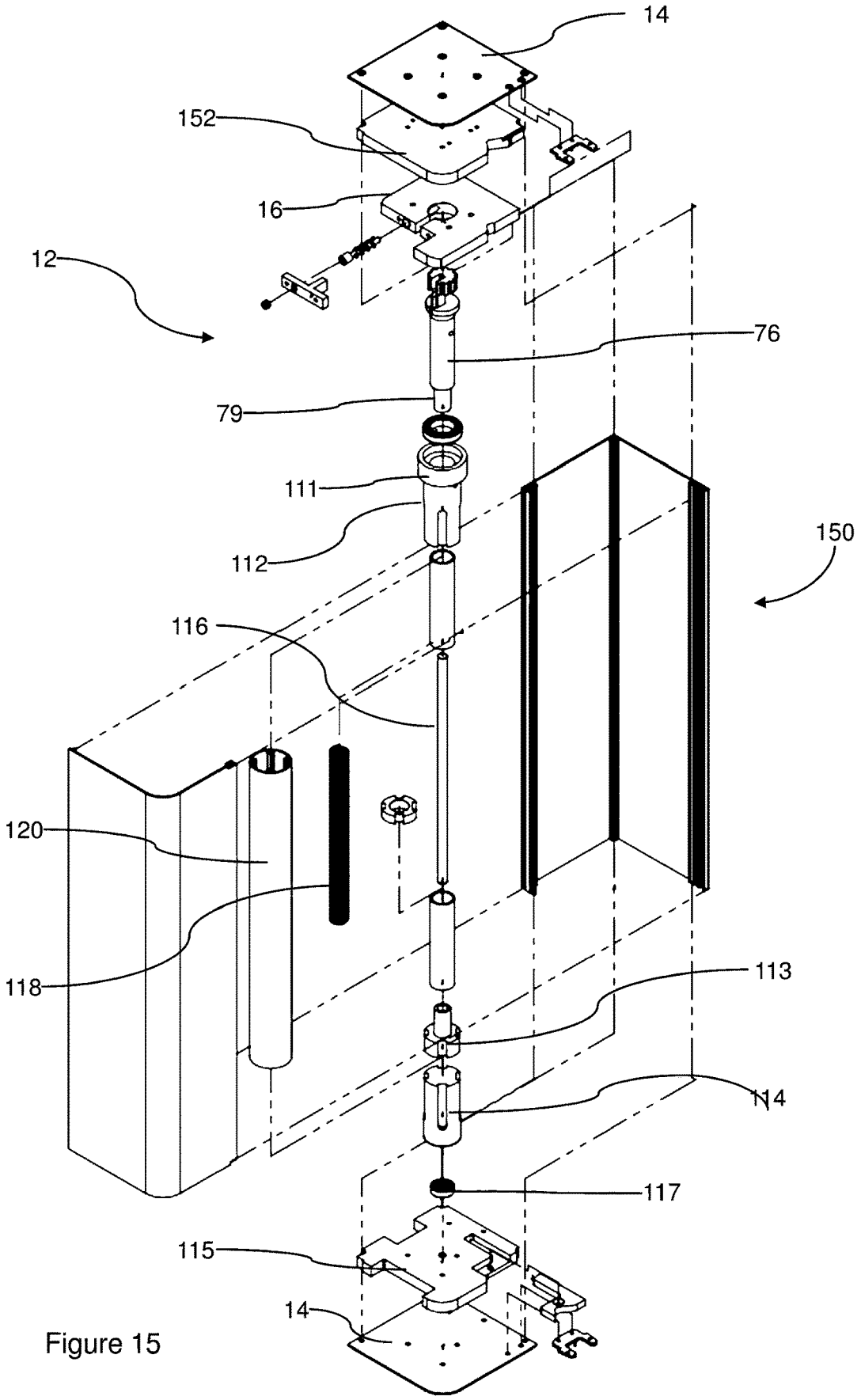
FIG. 15 is an exploded technical drawing of another example of a cassette for various embodiments of a screen assembly.
Figure 16:
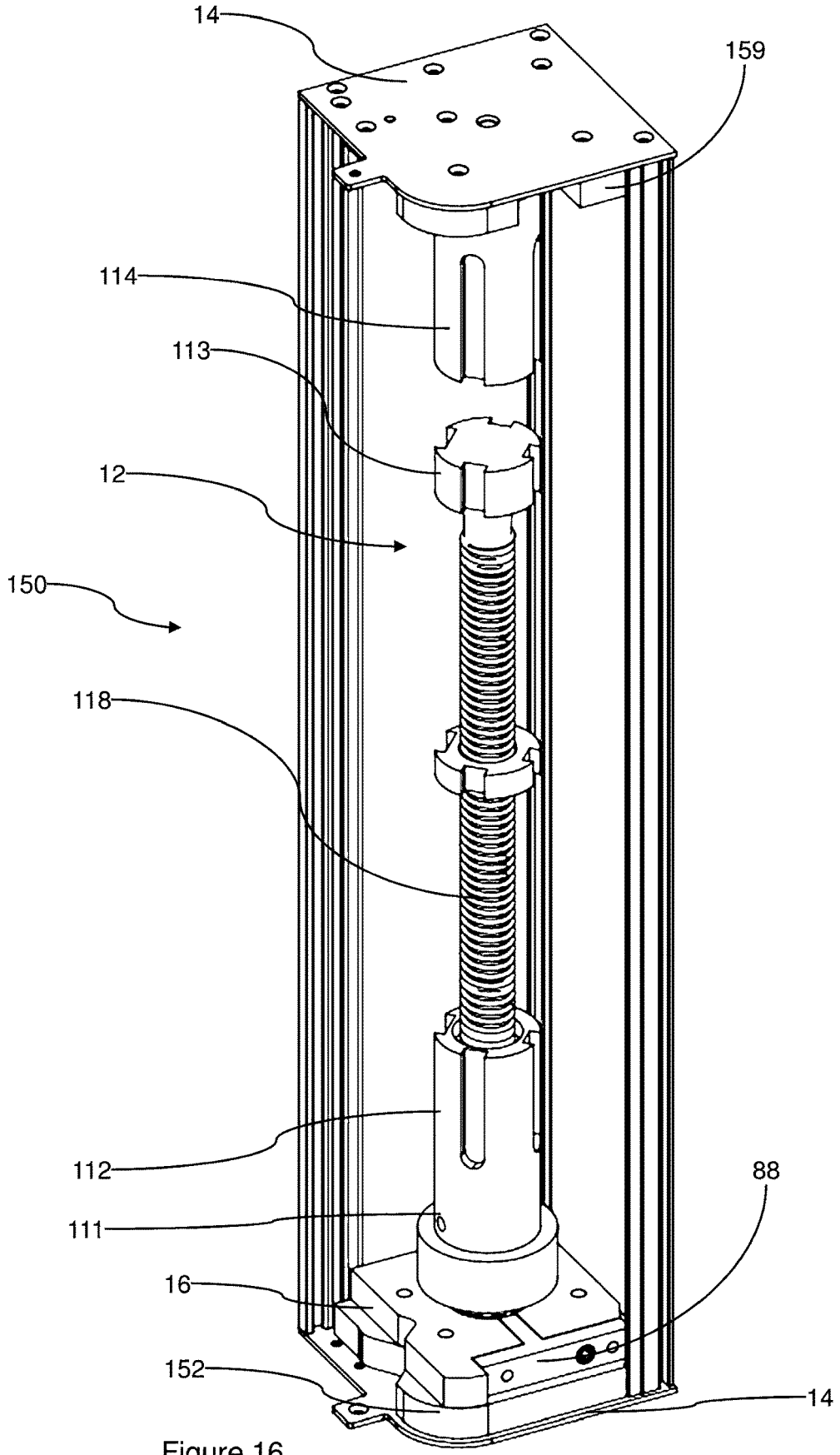
FIG. 16 is a perspective view of the cassette of FIG. 15 with a housing cover removed to show a roller assembly of the cassette.

In FIGS. 15 and 16, reference numeral 150 generally indicates a cassette of various embodiments of a screen assembly. The cassette 150 includes a retainer plate 152 interposed between the side plate 14 and the bracket 16.

Figure 17:
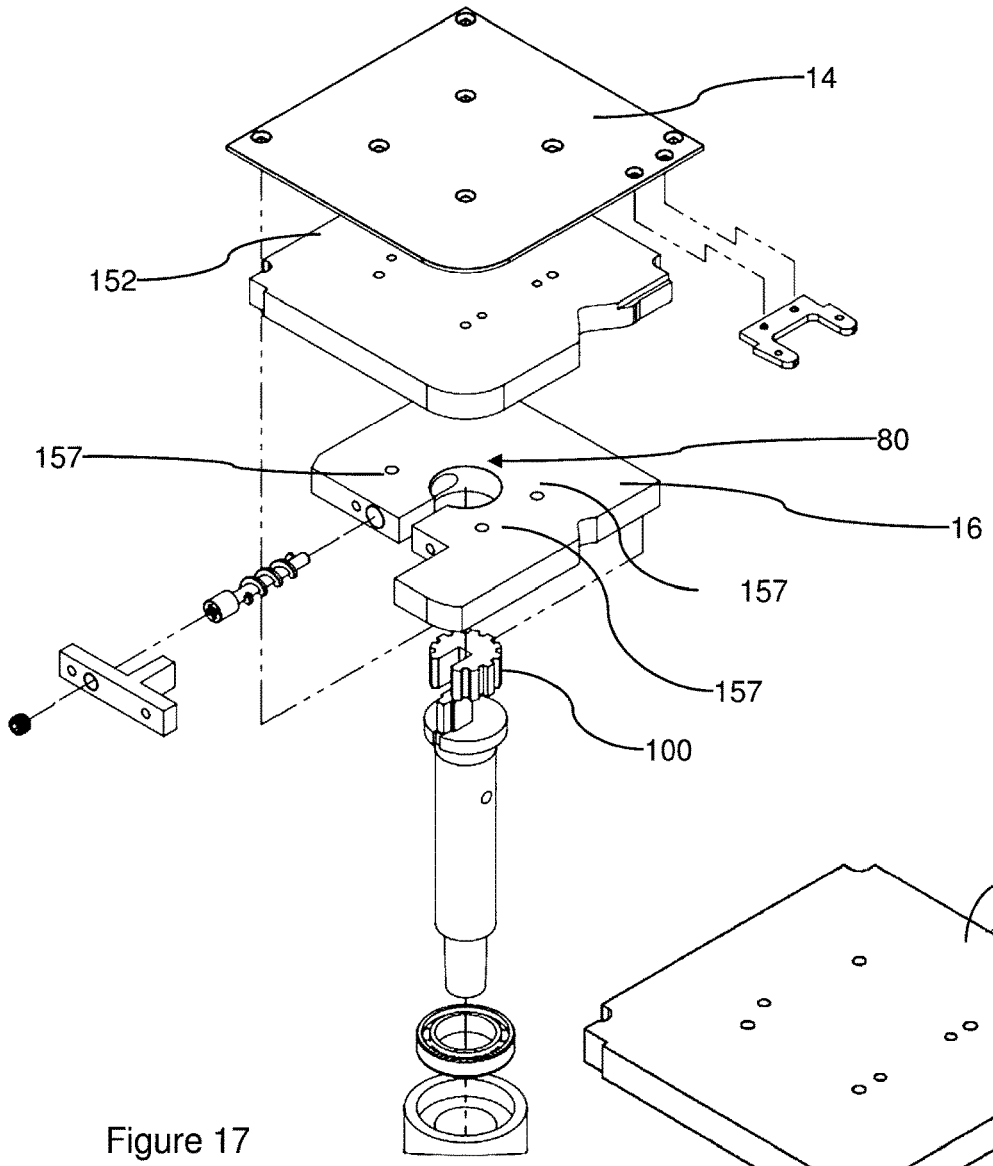
FIG. 17 is an exploded view of a drive assembly of the roller assembly of the cassette of FIG. 15.
Figure 18:
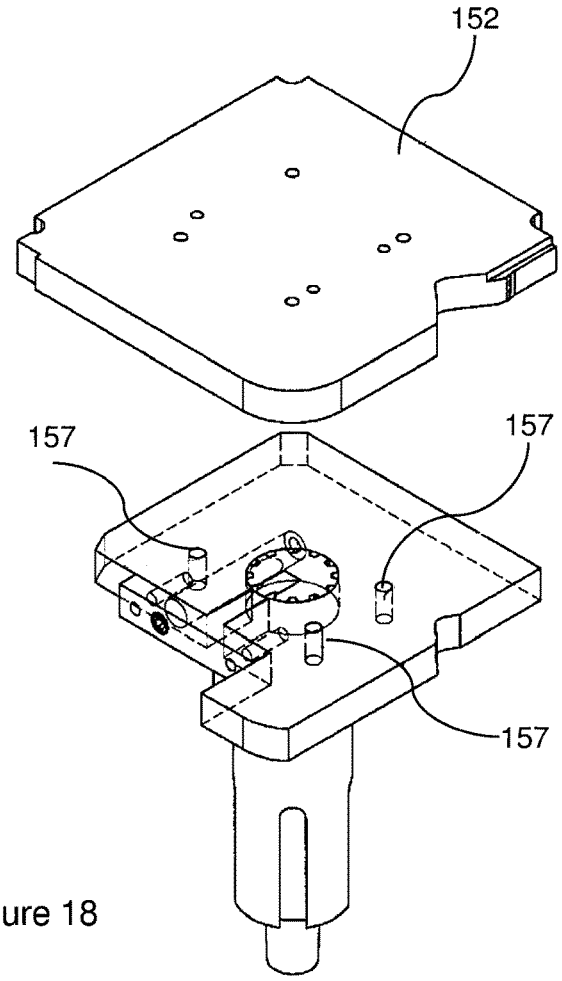
FIG. 18 is a partly perspective view, showing hidden detail, of the drive assembly of FIG. 17.
Figure 19:
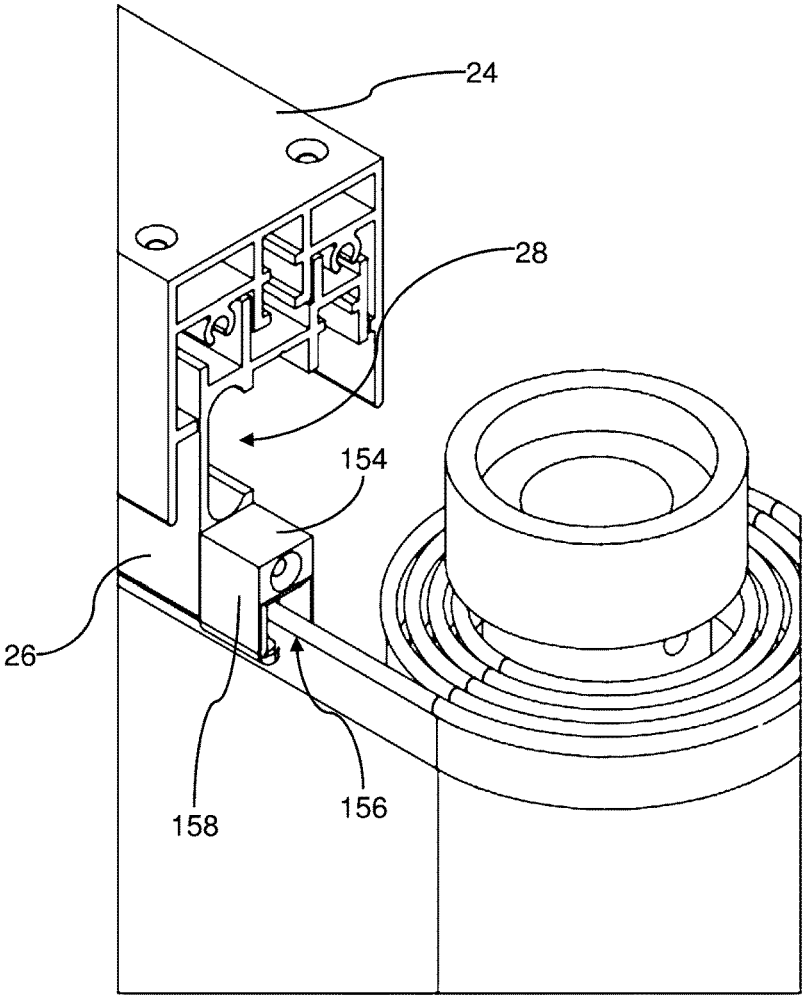
FIG. 19 shows a cutaway view, from a rear side, of an adjustable track assembly of a screen assembly.

Further detail of the retainer plate 152 can be seen in FIGS. 17 and 18. The retainer plate 152 is fastened to the bracket 16 with fasteners that extend through the bracket 16 and slotted openings 157. Screws engage ends of the fasteners that extend through the slotted openings 157. The retainer plate 152 is fastened to the side plate 14. The slotted openings 157 are oriented so that the fasteners can slide to and fro within the openings 157 to adjust an angular orientation of the roller assembly 12. This mechanism allows a level of adjustment to achieve accurate positioning of the latch assembly 52 and the further latch assembly, described below. In the embodiments described below, there are two latch assemblies that are required to align accurately with each other when brought together. The angular adjustment of the roller assembly referred to above allows the latch assemblies to be adjusted relative to each other so that such accurate alignment can be achieved.

Figure 21:
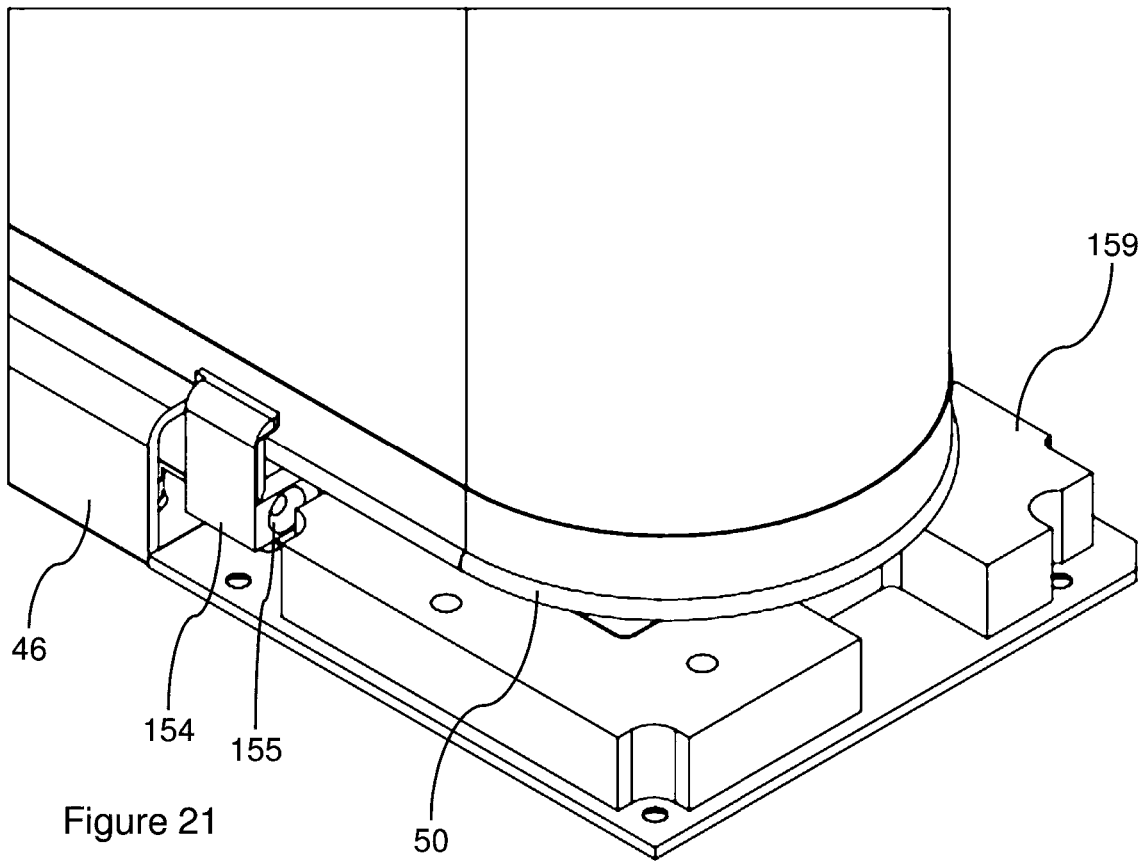
FIG. 21 shows a rear view of the static track assembly of FIG. 19.
Figure 22:
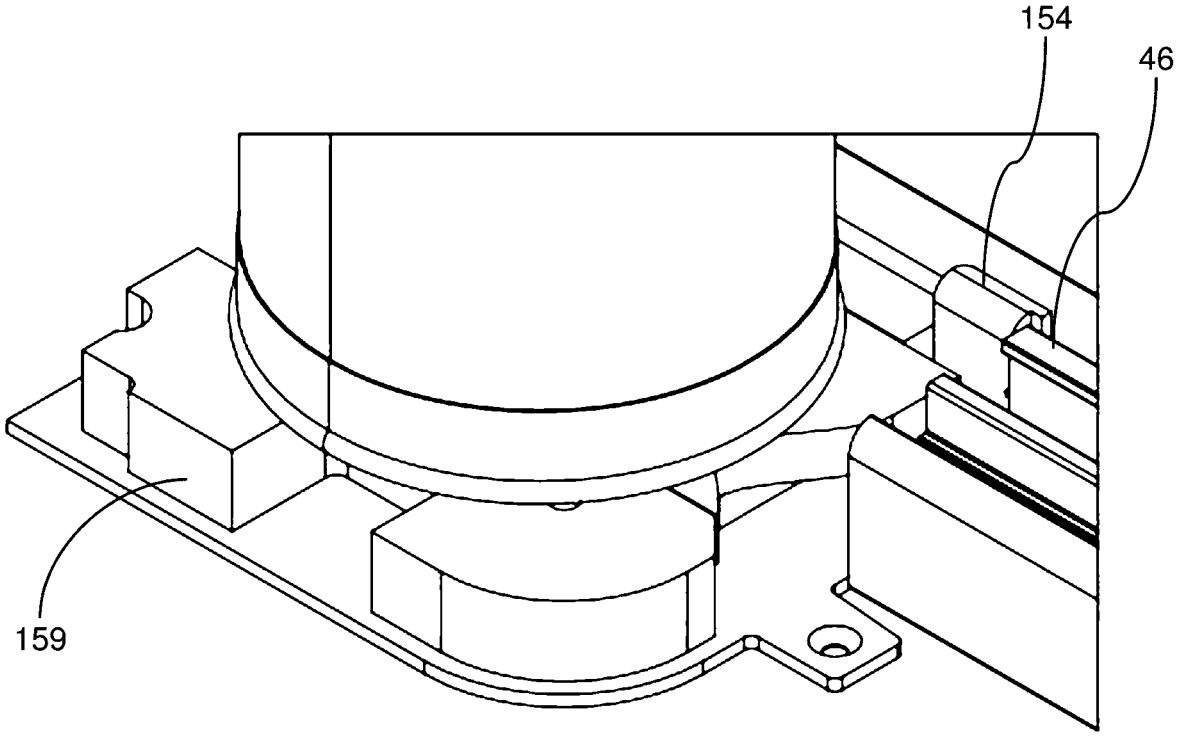
FIG. 22 shows a close-up front view of the static track assembly of FIG. 21.
Figure 23:
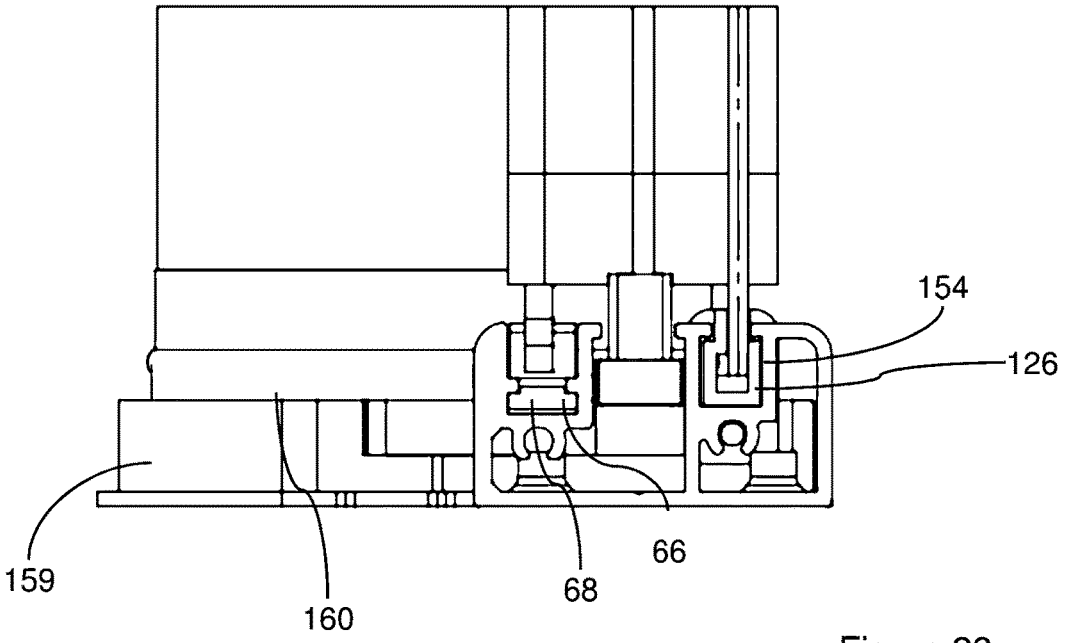
FIG. 23 shows a schematic sectioned view of a stopper and part of a latch assembly of the screen assembly of FIG. 19.
Figure 24:
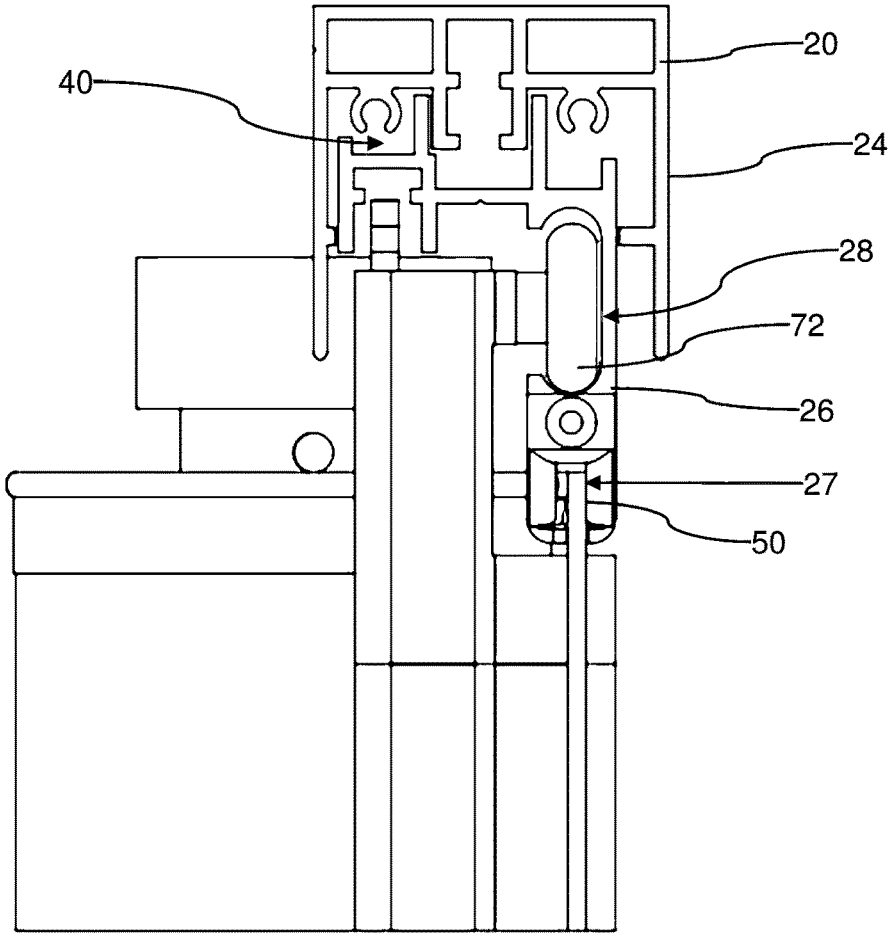
FIG. 24 shows a schematic sectioned view of the adjustable track assembly of FIG. 19.

It is a problem with existing roller assemblies that flexible panels tend to "cone" as they are wound onto rollers. As described above, the bead or zip track 27 is dimensioned to provide an extent of play for the zip or bead when sliding within the zip track 27. Without some form of guide, the "coning" could still occur as a result of the zip or bead moving within the zip track 27 as it is wound onto the roller assembly 12, especially when the assembly is in a vertical orientation. This is exacerbated by the fact that the bead has a curved cross-sectional profile. As a result, consecutive coils of the bead tend to slip relative to each other. A shim, spacer or packer 159, also shown in FIG. 16, is mounted on the side plate 14. The packer 159 supports the bead 50 as the bead 50 is rolled onto the roller assembly 12. Together with the zip track 27, this inhibits the panel 48 from coning. The packer 159 is also shown in FIGS. 21 and 22. When the roller assembly 12 is vertically oriented, as in FIGS. 21 and 22, or, when the representation in FIG. 16 is viewed in the alternative at 90°, the packer 159 is located at the base of the assembly 12. This location ensures that the packer 159 supports the bead 50 as it is rolled onto the assembly 12. This helps to ensure that consecutive coils of the bead 50 do not slip relative to each other and so inhibits coning of the panel 48.

In FIGS. 19 to 22 there is shown a zip or bead guide 154 that is mounted on the dynamic support 26 of the adjustable track assembly 20 (FIG. 20) and on the static support 46 (FIG. 21). The bead guide 154 is mounted on an end of the support 26, 46 proximate the roller assembly 12. Thus, a length of the bead guide 154 is selected such that the bead guide 154 can be as close as possible to a fully wound screen, without interfering with the screen. The length of the bead guide 154 is related to the length of the flexible panel 48. The bead guide 154 defines a passage 155 that is in register with a complementary formation 157 to allow an elongate fastener to be used to fasten the guide 154 to the dynamic support 26 or to the static support 46.

Figure 20:
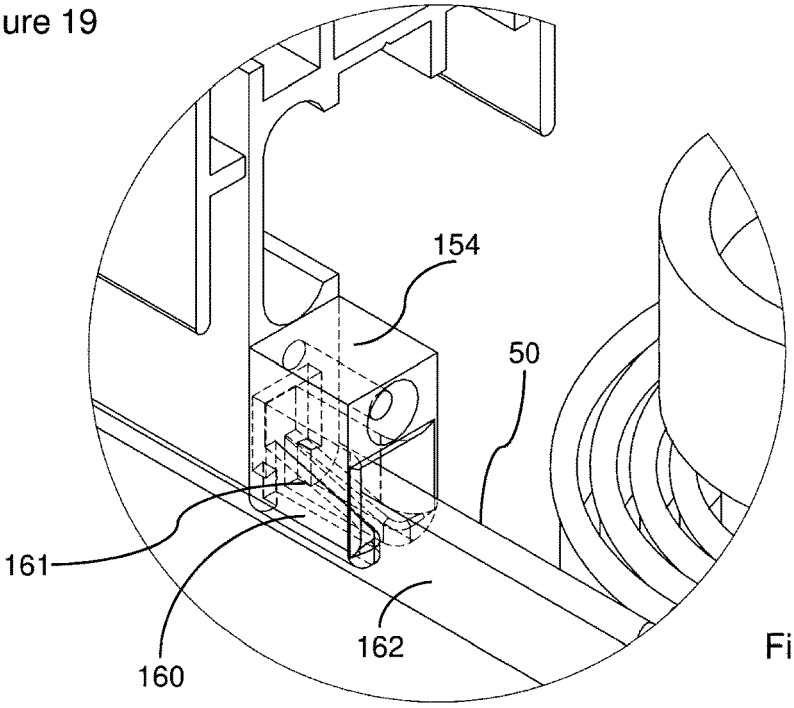
FIG. 20 shows a further, detailed cutaway view, from a rear side, of the adjustable track assembly of FIG. 19.

The bead guide 154 defines a channel 156 in which the bead 50 is received. The channel 156 has walls 158 with opposed, inwardly extending retaining formations 160 that engage the bead 50 so that the bead 50 slides over the formations 160 before being wound onto the roller assembly 12. As can be seen in FIG. 20, each of the formations 160 has a sloped, internal surface 161 (shown in dashed line) that extends inwardly, relative to the panel 48, in a winding direction. This sloped, or ramped surface inhibits the bead 50 from snagging. Also, the bead guide 154 can combine functionally with the packer 159 to inhibit coning of the panel 48.

In this example, the flexible panel 48 has a border strip 162 that extends inwardly from the bead 50. The border strip 162 is conventional and is used to secure a mesh 165 to the bead 50. It will readily be appreciated that, as set out above, various other forms of flexible panel can be used.

The formations 160 are shaped to engage the bead 50 of the strip 162 so that the strip 162 slides over the formations 160. In this manner, a lateral position of the bead 50 can be maintained while the flexible panel 48 is rolled onto the roller assembly 12, to avoid coning.

As can be seen in the drawings, the bead guide 154 is shaped so as to present curved surfaces. Thus, damage to the flexible panel 48 can be minimised or avoided.

Figure 25:
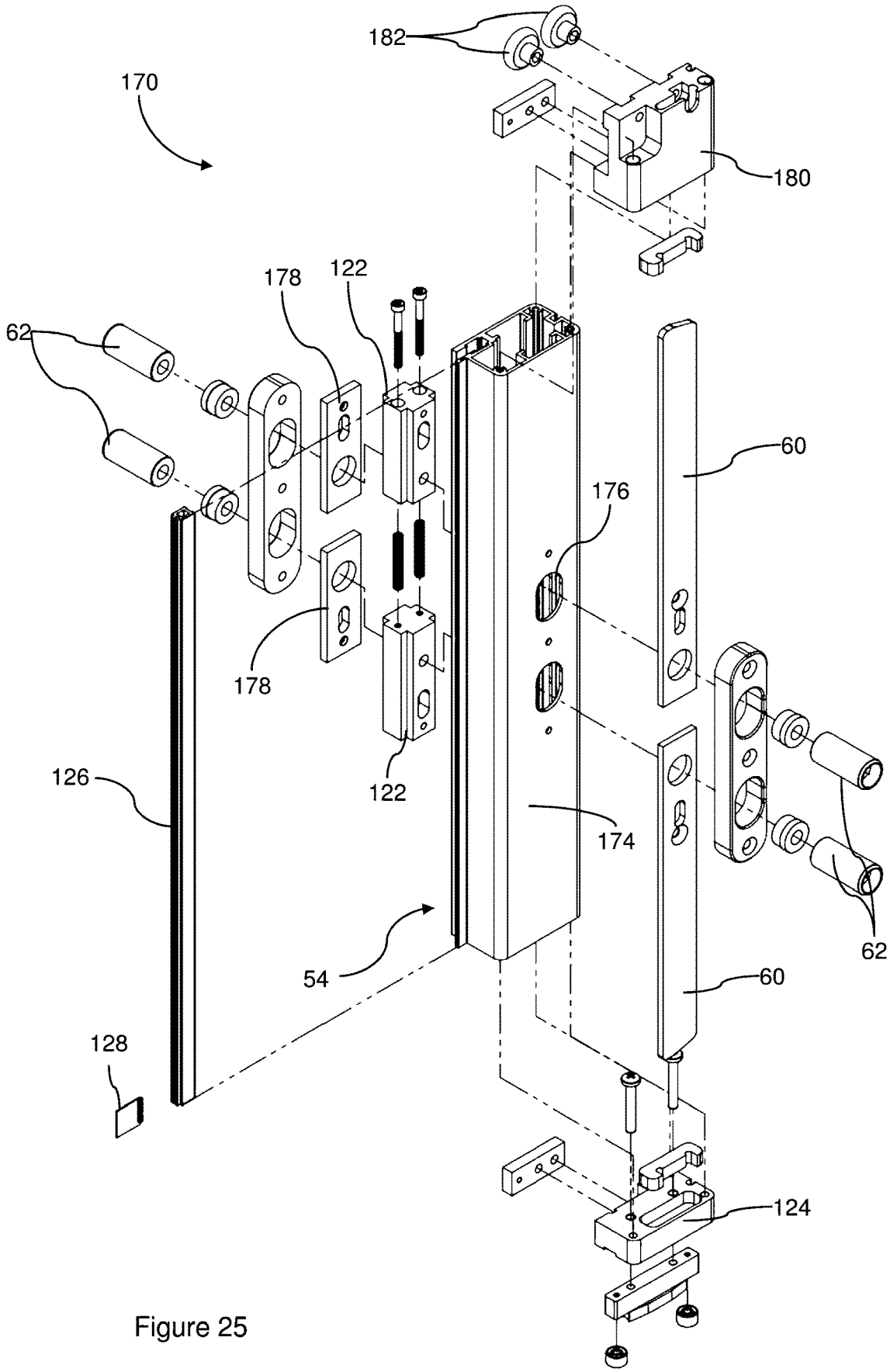
FIG. 25 shows an exploded technical drawing of a latch assembly for use with various embodiments of a screen assembly.
Figure 26:
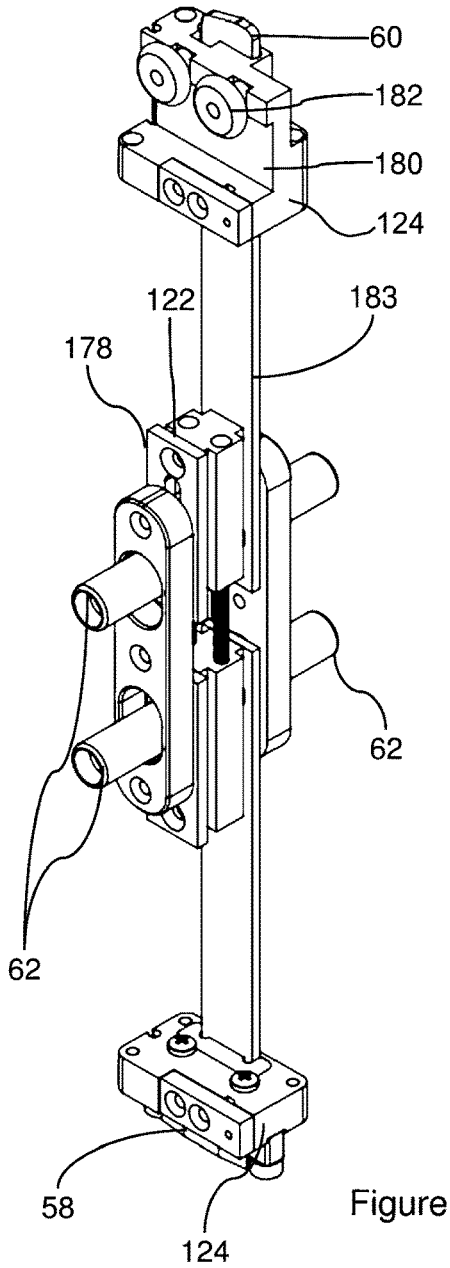
FIG. 26 shows a partly dismantled, three-dimensional view of the latch assembly of FIG. 25.
Figure 27:
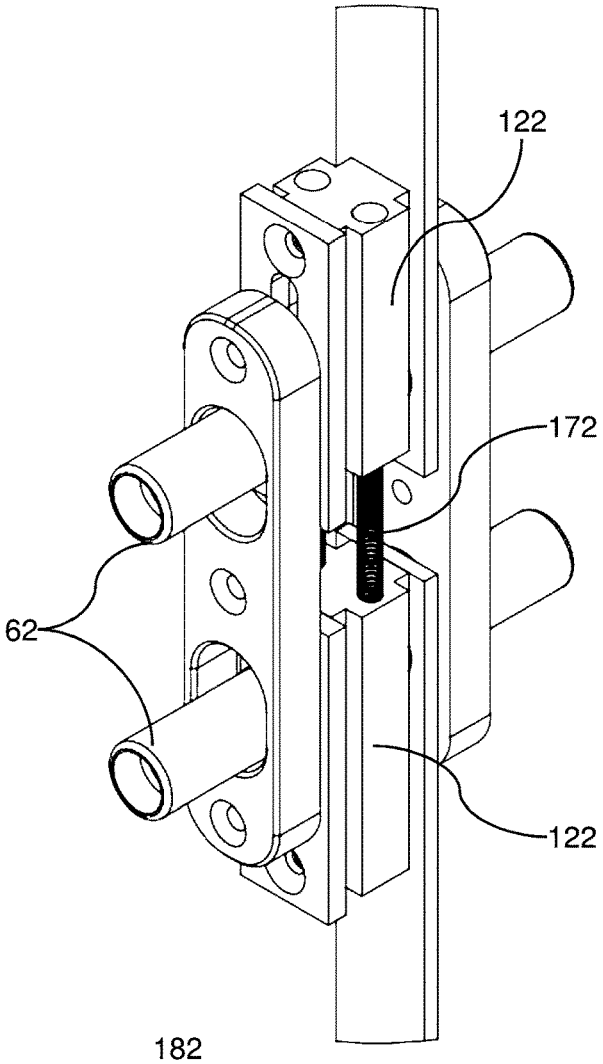
FIG. 27 shows a handle mechanism of the latch assembly of FIG. 25.
Figure 28:
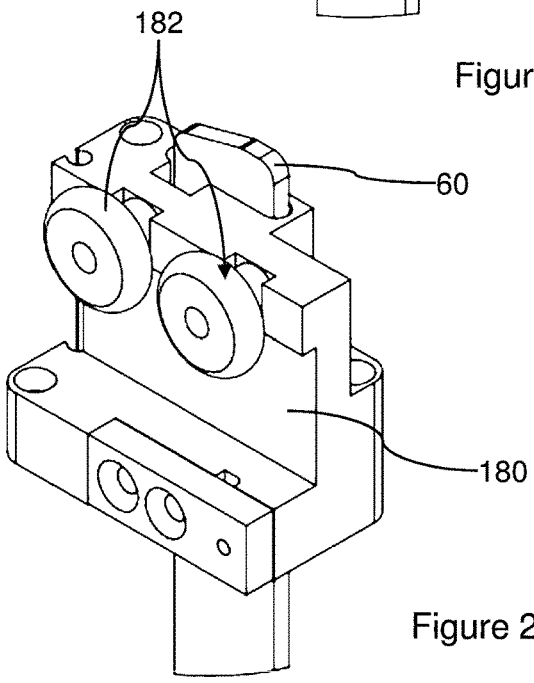
FIG. 28 shows a latch and a pair of guide wheels or rollers of the latch assembly of FIG. 25.

In FIG. 25, reference numeral 170 generally indicates an exploded drawing of a latch assembly for the screen assembly 10. FIGS. 26 to 28 show further detail of the latch assembly 170.

The latch assembly 170 is similar to the latch assembly 52.

The exploded drawing of FIG. 25 shows each latch block 122 mounted to each respective latch 60 through a latch body 174 and between two handles 62, one handle 62 extending from each side of the latch housing 54. The latch body 174 accommodates the latch blocks 122 so that the latch blocks 122 can be displaced towards and away from each other within the latch body 174. The latch blocks 122 are biased away from each other with a spring mechanism that can be in the form of a pair of springs 172 arranged between the latch blocks 122.

Each latch block 122 is sandwiched between handle mounts 178 and latches 60. Each handle mount 178 is accessible via a slotted opening 176 defined in the latch body 174. One handle 62 extends through each respective opening 176 and is mounted through a latch 60 to an associated latch block 122 with one of the handle mounts 178. Thus, each handle mount 178 is interposed between one handle 62, one latch 60 and one associated latch block 122.

Each latch 60 is therefore also associated with one respective latch block 122 and one handle 62.

Thus, the latches 60 are drawn towards each other with the handles 62 against a bias. When the latches 60 are released, the latches 60 move automatically into a position in which they extend from the housing 54 to bear against stoppers 66, as described above.

A wheel mount 180 is mounted on one end of the latch body 174 proximate the adjustable track assembly 20. Two guide wheels 182 are rotatably mounted on the wheel mount 180 to be received in the runner channel 28 in the manner described above with reference to the guide wheels 72.

A rail 183 extends between the end caps 124 and is configured so that the assembled handles 62, latch blocks 122, and mounts 178 can slide to and fro along the rail 183. The rail 183 can be of various materials, including PVC and aluminium.

Figure 29:
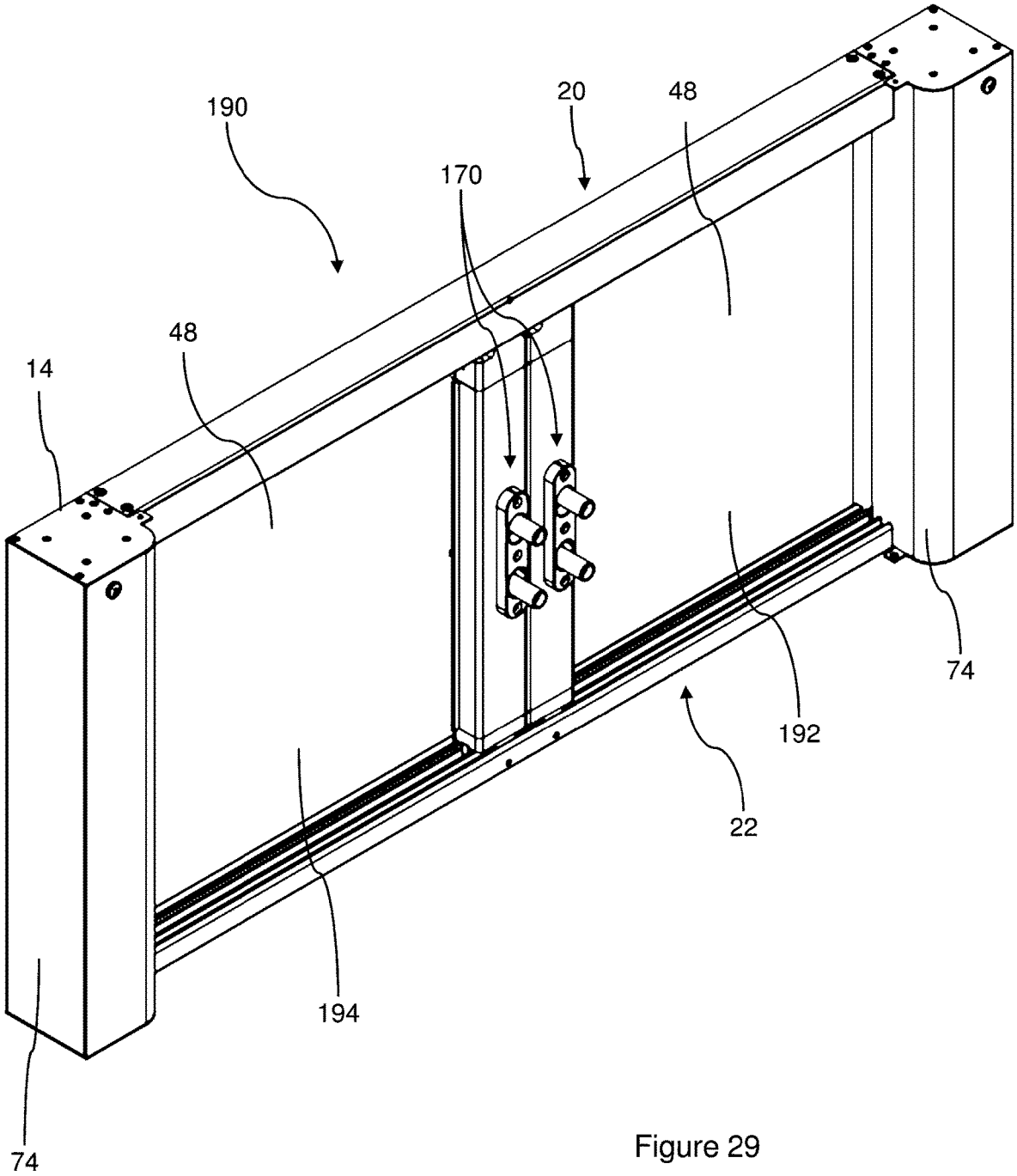
FIG. 29 shows a three-dimensional view of a screen assembly according to an embodiment of the present disclosure.

In FIG. 29, reference numeral 190 shows a further embodiment of a screen assembly according to this disclosure.

The screen assembly 190 includes two cassettes 74 that are oppositely oriented relative to each other. The cassettes 74 are mounted on respective ends of the track assemblies 20, 22.

Two latch assemblies 170 are mounted between the track assemblies 20, 22 in the manner described above. Thus, in a horizontal orientation, the screen assembly 190 forms a double-sided closure, or, as shown in the drawing, a closure on one side 192 and a screen or mesh on an opposite side 194. With the flexible panels 48 being of sufficient length, the screen assembly 190 provides a system whereby a user can select to what extent an opening is covered by a closure or by a mesh or screen.

Figure 30:
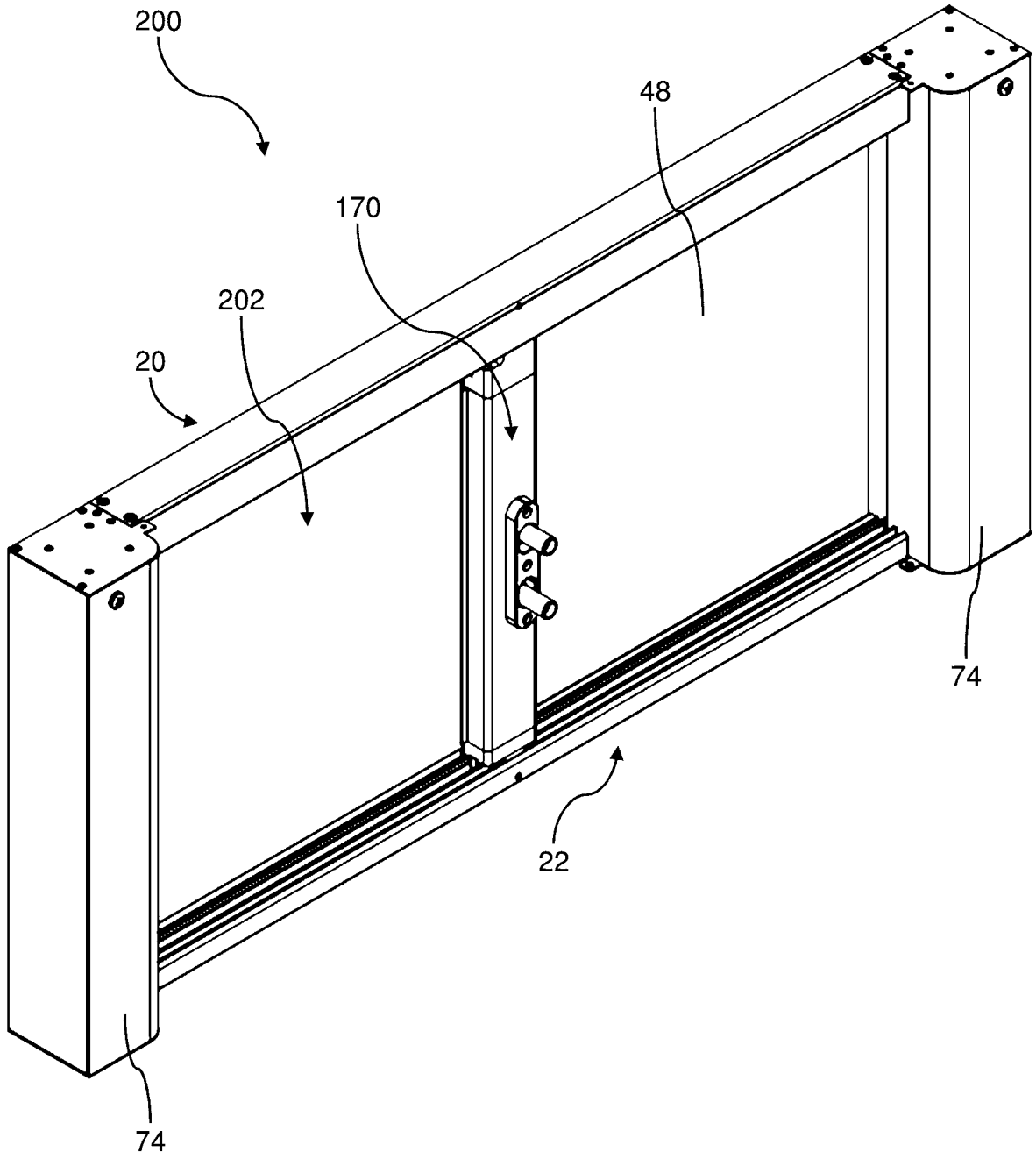
FIG. 30 shows a three-dimensional view of a screen assembly according to a further embodiment of the present disclosure.
Figure 31:
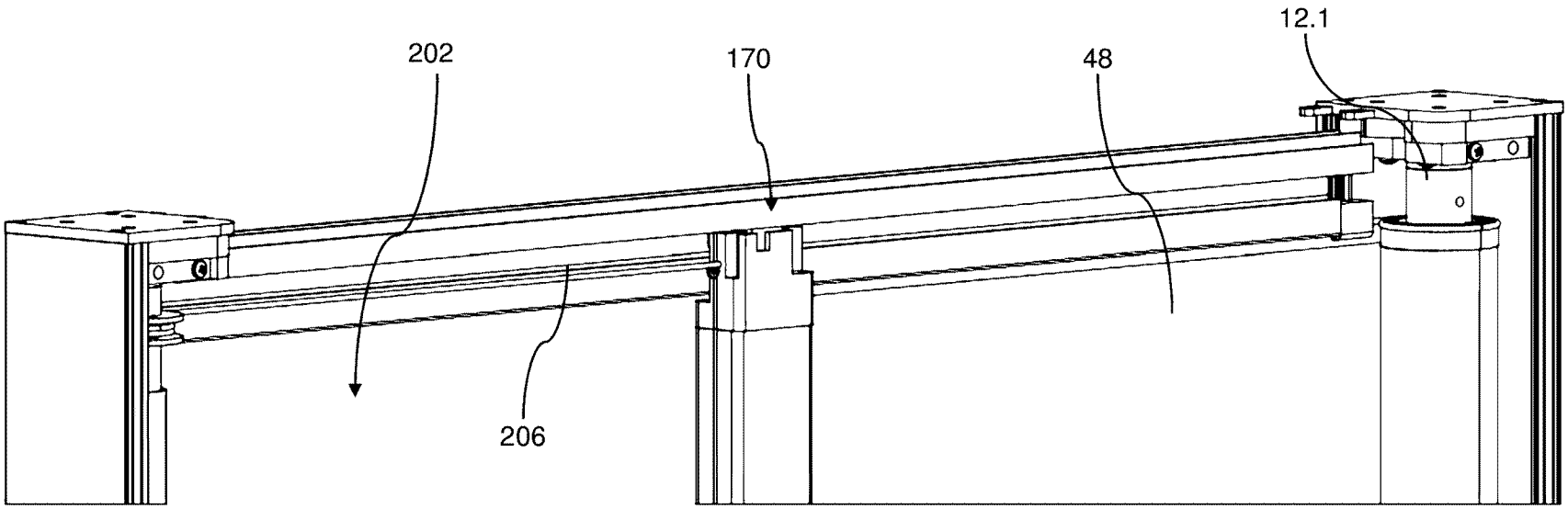
FIG. 31 shows a partly dismantled, front three-dimensional view of the screen assembly of FIG. 30.
Figure 32:
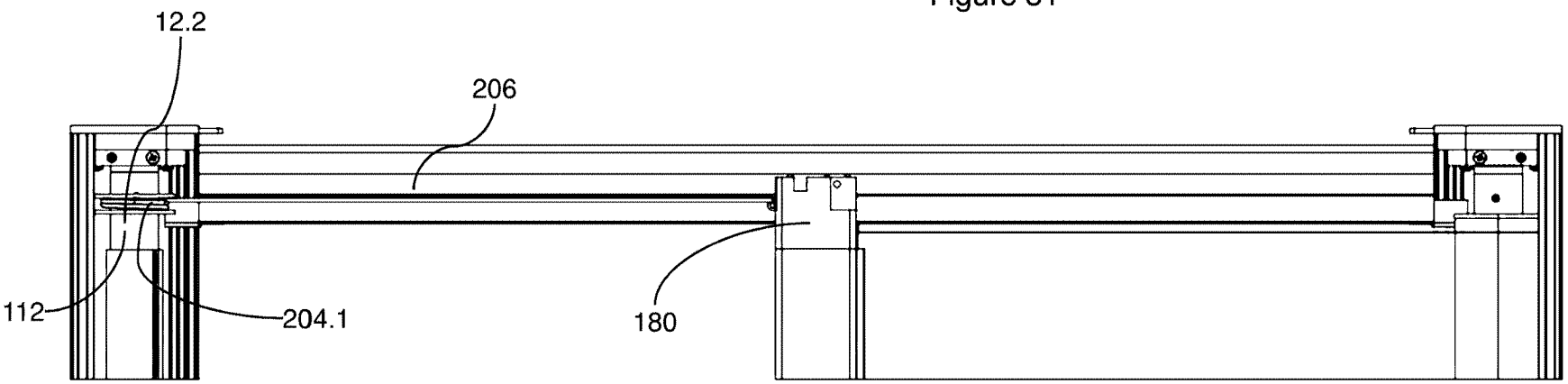
FIG. 32 shows a front view of an assist mechanism of the screen assembly of FIG. 30.

In FIG. 30, reference numeral 200 generally indicates a further embodiment of a screen assembly according to the disclosure.

Further detail of the screen assembly 200 can be seen in FIGS. 31 to 36.

As with the screen assembly 190, the screen assembly 200 also has two opposed cassettes 74. Roller assemblies 12 of the cassettes 74 are similar. In particular, a tension within the spring 118 of each roller assembly 12 can be adjusted in the manner described above.

The flexible panel 48 is mounted on one of the roller assemblies 12.1, in the manner described above. Furthermore, the flexible panel 48 is of sufficient length to allow the latch assembly 170 to be drawn all the way to the opposed roller assembly 12.2. Thus, an opening 202 defined by the roller assemblies 12 and the track assemblies 20, 22 can be opened or closed to a desired extent by positioning the latch assembly 170 appropriately.

It will be appreciated that the further the latch assembly 170 is drawn away from the roller assembly 12.1, the greater the tension build up in the spring 118. As result, it may be difficult for the opening 202 to be closed by a person of lower than average strength.

Figure 33:
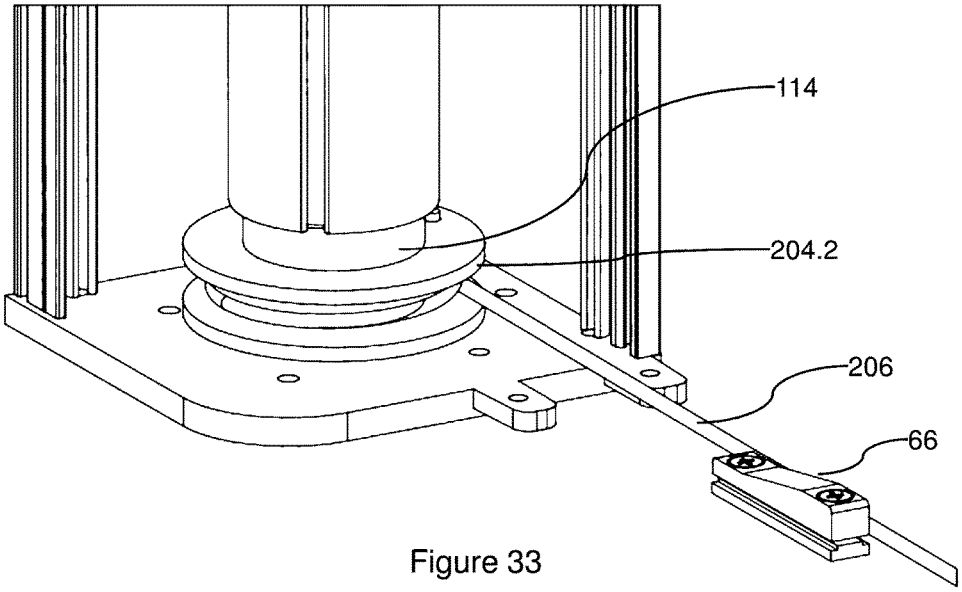
FIG. 33 shows a pulley assembly of the screen assembly of FIG. 30.
Figure 34:
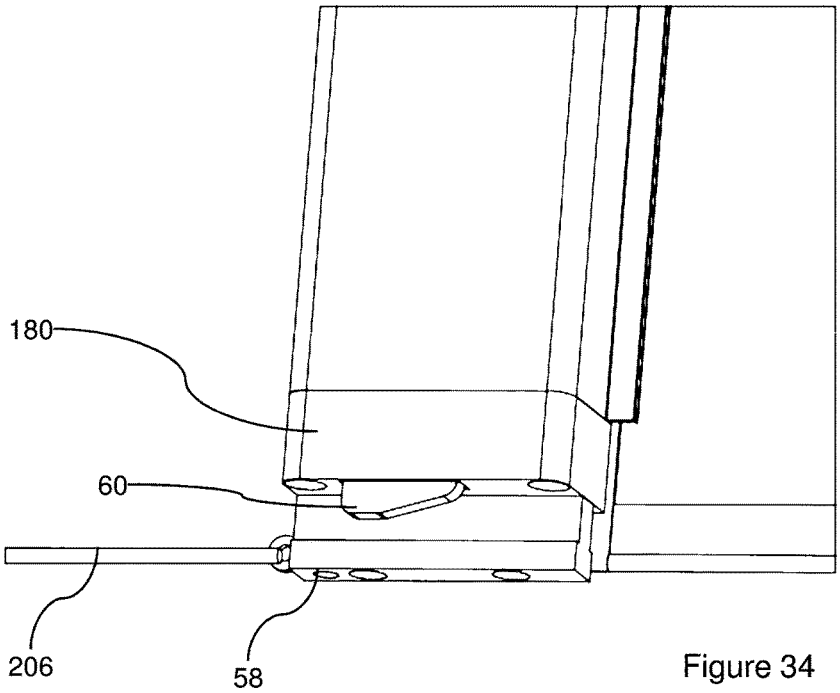
FIG. 34 shows a latch of the screen assembly of FIG. 30.
Figure 36:
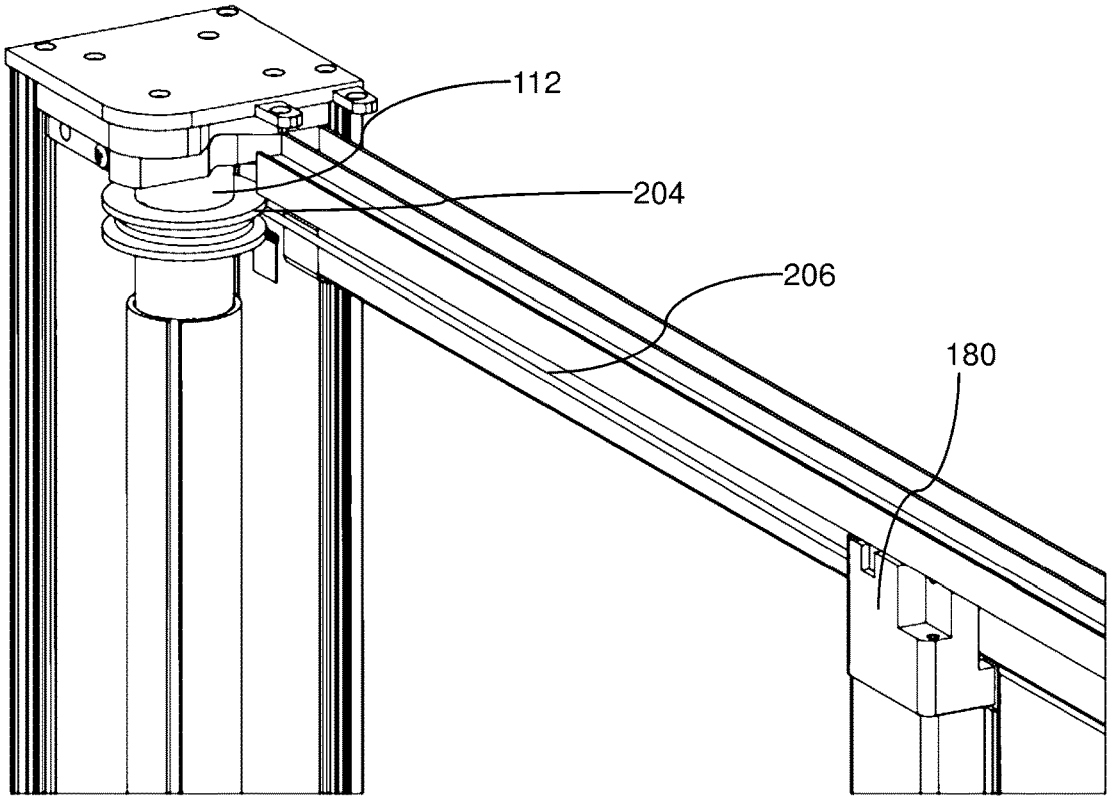
FIG. 36 shows a further view of a pulley assembly of the screen assembly of FIG. 30.
Figure 35:
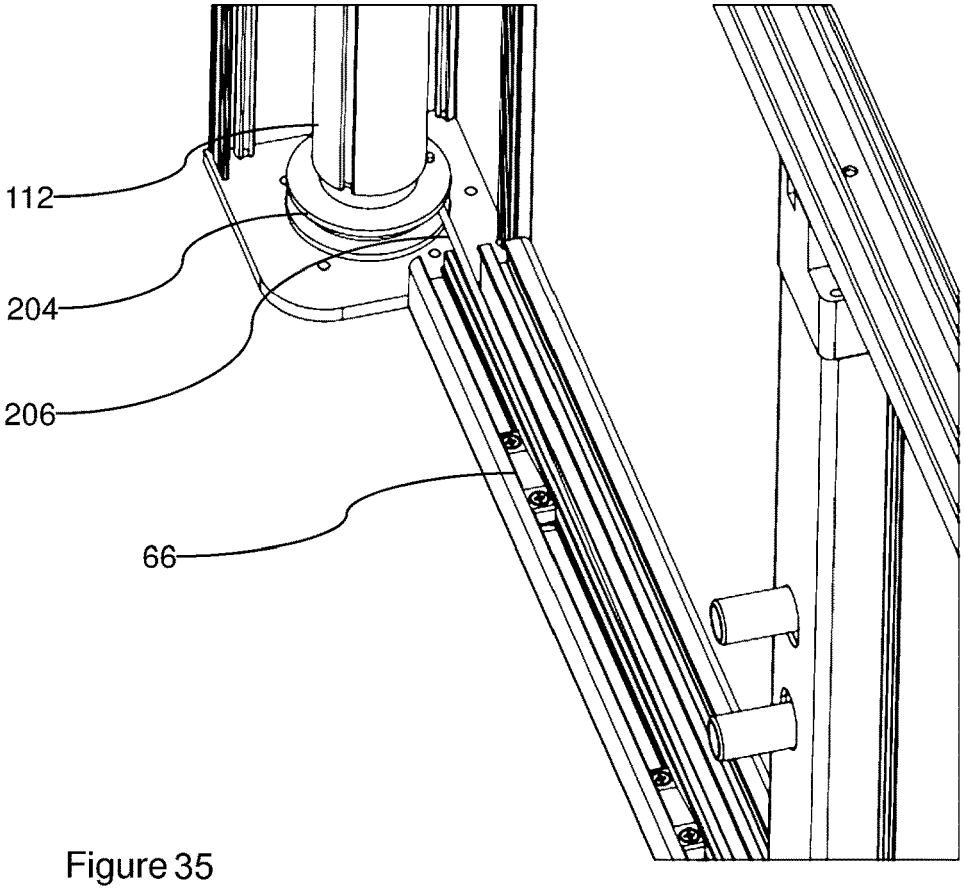
FIG. 35 shows a further view of a pulley assembly of the screen assembly of FIG. 30.

Thus, a pulley 204.1 (FIG. 32) is mounted on the drive collar 112 of the roller assembly 12.2 to be generally aligned with the wheel mount 180. A pulley 204.2 (FIG. 33) is mounted on the bearing tube collar 114 (FIG. 33). Thus, the pulleys 204.1 and 204.2 are positioned at opposite ends of the roller assembly 12.2 to be generally aligned with respective wheel mount 180 and formation 58. A length of cord 206 is wound onto each pulley 204 and connected to the associated wheel mount 180 and guide formation 58. The cords 206 are wound onto the pulleys 204 in a manner such that the pulleys 204 can rotate the roller tube 120 against a tension of the spring 118 as the cords 206 are wound off the pulleys 204.

Thus, as the latch assembly 170 is drawn away from the roller assembly 12.2, to open the opening 202, the cords 206 serve to rotate the pulleys 204 against a bias of the roller assembly 12.2. However, as set out above, in the extended condition of the panel 48, a level of tension is built up within the spring 118 of the roller assembly 12.1. Thus, a bias of the roller assembly 12.1 can serve to assist in the retraction of the panel 48 against a bias of the roller assembly 12.2.

It will be appreciated that the springs 118 can be pre-tensioned, via the worm gears 108, in the manner described above, to achieve a certain level of effort required either to extract or retract the panel 48.

Depending on the manner in which the springs 118 are pre-tensioned, the latch assembly 170, will, if unrestrained, tend to move either towards or away from one of the cassettes 74. Thus, the screen assembly 200 includes one or more of the stoppers 66, described above, to stop the latch assembly 170 at a desired position.

The screen assembly 200 provides a means whereby the roller assemblies 12 can be used to achieve a closure assembly that incorporates, with suitable adjustment, assisted opening or closing.

The appended claims are to be considered part of this description.

Throughout the specification, including the claims, where the context permits, the term "comprising" and variants thereof such as "comprise" or "comprises" are to be interpreted as including the stated integer or integers without necessarily excluding any other integers.

Throughout the specification, the use of common reference numerals is to denote components that are common to the drawings in which the reference numerals are used. The purpose of this denotation is for convenience only and is not intended to limit the scope of the appended claims.

Words indicating direction or orientation, such as "front", "rear", "back", etc., are used for convenience. The inventor envisages that various embodiments can be used in a non-operative configuration, such as when presented for sale. Thus, such words are to be regarded as illustrative in nature, and not as restrictive.

It is to be understood that the terminology employed above is for description of embodiments and should not be regarded as limiting. The described embodiments are intended to be illustrative of the invention, without limiting the scope thereof. The invention is capable of being practiced with various modifications and additions as will readily occur to those skilled in the art.

The invention claimed is:

1. A screen assembly that comprises:

a support structure;

a roller assembly mounted on the support structure;

a flexible panel with a distal end mounted on the roller assembly so that the flexible panel can be wound onto and off the roller assembly as the flexible panel is retracted and extended;

two opposed track assemblies arranged on the support structure, sides of the flexible panel and each track assembly being configured so that the sides of the flexible panel can slide to and fro, longitudinally, within the track assemblies as the flexible panel is retracted and extended, at least one of the track assemblies having a static support that is fixed relative to the support structure and a dynamic support that is displaceable relative to the static support, a bead guide at or near an end of at least one of the dynamic support and the static support, proximate the roller assembly;

an adjustment mechanism that is operatively connected to the static and dynamic supports to adjust a position of the dynamic support relative to the static support;

an elongate guide assembly that is mounted on a proximal end of the flexible panel to guide movement of the flexible panel with respect to the track assemblies;

an insert mounted on at least one end of the guide assembly; and the dynamic support of said at least one of the track assemblies including a runner in which the insert is received to slide or roll with respect to the dynamic support as the flexible panel is retracted and extended;

in which the support structure includes a top side member and an opposed bottom side member, the roller assembly being mounted between the side members; such that the support structure and the roller assembly are configured for generally vertical orientation so that the flexible panel can extend generally horizontally, the bead guide being positioned to support a bead of the flexible panel during such horizontal extension.

2. The screen assembly as claimed in claim 1, in which the bead guide defines a channel containing at least one retaining formation with an internal slope to support a bead of the flexible panel before being wound on to the roller assembly.

3. The screen assembly as claimed in claim 1, in which at least one of the track assemblies defines a longitudinally extending guide formation, the guide assembly including at least one guide that is received in the guide formation to guide movement of the guide assembly with respect to the track assemblies.

4. The screen assembly as claimed in claim 3, in which the guide assembly includes a carrier that at least spans the flexible panel, the at least one guide being one guide that extends from one side of the carrier to be received in the guide formation that is defined by the static support and the insert extending from an opposite side of the carrier to be received in the runner.

5. The screen assembly as claimed in claim 4, in which the insert is in the form of at least one roller, the, or each, roller and the runner being configured so that the, or each, roller can roll to and fro within the runner as the flexible panel is retracted and extended.

6. The screen assembly as claimed in claim 5, in which one of the track assemblies has the static support and the dynamic support and the, or each, roller is mounted on one end of the carrier that corresponds with said one of the track assemblies.

7. The screen assembly as claimed in claim 4, in which the guide assembly further includes at least one latch that can extend from at least one respective end of the carrier.

8. The screen assembly as claimed in claim 7, in which the, or each, latch can be extended or retracted with respect to the carrier to engage at least one respective track assembly.

9. The screen assembly as claimed in claim 8, in which the at least one latch is connected to a corresponding at least one handle included in the guide assembly to enable extension or retraction of the, or each, latch upon operation of the handle.

10. The screen assembly as claimed in claim 7, in which one or more stoppers are arranged in at least one of the track assemblies to form a stop for the, or each, latch when the, or each, latch is extended.

11. The screen assembly as claimed in claim 1, in which at least one of the dynamic support and the static support includes a bead guide on the end proximate the roller assembly.

12. The screen assembly as claimed in claim 11, in which the bead guide defines a channel containing at least one retaining formation with an internal slope to engage a bead of the flexible panel before being wound on to the roller assembly.

13. The screen assembly as claimed in claim 1, in which the support structure includes an elongate housing and two, opposed side members arranged at respective ends of the elongate housing, the roller assembly being mounted between the side members.

14. The screen assembly as claimed in claim 13, in which a bracket is mounted on one of the side members to support a drive end of the roller assembly.

15. The screen assembly as claimed in claim 13, in which a guide member is positioned on one of the side members and configured to guide an edge of the flexible panel as it is rolled onto the roller assembly to inhibit coning of the flexible panel.

16. The screen assembly as claimed in claim 1, in which the opposed track assemblies are an upper track assembly and a lower track assembly, the upper track assembly including the static and dynamic supports.

17. The screen assembly as claimed in claim 16, in which a guide member is arranged on an inner side of the bottom side member and is configured to guide an edge of the flexible panel as it is rolled onto the roller assembly to inhibit coning of the flexible panel.

* * * * *